US007174227B2

(12) United States Patent
Kobayashi et al.

(10) Patent No.: US 7,174,227 B2
(45) Date of Patent: Feb. 6, 2007

(54) LAUNDRY SYSTEM INCLUDING HOME TERMINAL DEVICE AND LAUNDRY APPARATUS WITH COMMUNICATING FUNCTION

(75) Inventors: Midori Kobayashi, Seto (JP); Hiroyuki Haruna, Nagoya (JP); Fumihiro Imamura, Seto (JP); Yoshimi Nishimura, Seto (JP); Miho Hayashi, Seto (JP)

(73) Assignees: Kabushiki Kaisha Toshiba, Tokyo (JP); Toshiba Ha Products Co., Ltd., Osaka-Fu (JP); Toshiba Consumer Marketing Corp., Tokyo (JP)

( * ) Notice: Subject to any disclaimer, the term of this patent is extended or adjusted under 35 U.S.C. 154(b) by 183 days.

(21) Appl. No.: 10/501,900

(22) PCT Filed: Dec. 27, 2002

(86) PCT No.: PCT/JP02/13873

§ 371 (c)(1),
(2), (4) Date: Jul. 20, 2004

(87) PCT Pub. No.: WO03/062516

PCT Pub. Date: Jul. 31, 2003

(65) Prior Publication Data

US 2005/0109070 A1 May 26, 2005

(30) Foreign Application Priority Data

Jan. 22, 2002 (JP) ..... 2002-013384

(51) Int. Cl.
*G05B 15/00* (2006.01)

(52) U.S. Cl. ..... 700/83; 700/90; D32/5; D32/28

(58) Field of Classification Search ..... 700/15, 700/17, 19, 27, 33, 83, 90; 68/17 R, 17 A, 68/27, 2; D32/5, 6, 28
See application file for complete search history.

(56) References Cited

U.S. PATENT DOCUMENTS

| | | | | |
|---|---|---|---|---|
| 5,412,291 | A * | 5/1995 | Payne et al. | 318/102 |
| 5,438,507 | A * | 8/1995 | Kim et al. | 700/1 |
| 5,603,233 | A * | 2/1997 | Erickson et al. | 68/12.02 |
| 6,061,668 | A * | 5/2000 | Sharrow | 705/400 |
| 6,121,593 | A | 9/2000 | Mansbery et al. | 219/679 |
| 6,778,868 | B2 * | 8/2004 | Imamura et al. | 700/79 |
| 2001/0039190 | A1 * | 11/2001 | Bhatnagar | 455/450 |

FOREIGN PATENT DOCUMENTS

| | | | |
|---|---|---|---|
| DE | 199 05 533 | A1 | 8/2000 |
| EP | 1 186 695 | A2 | 3/2002 |
| EP | 1 217 475 | A2 | 6/2002 |
| JP | 2002-011275 | | 1/2002 |
| JP | 2002-011280 | | 1/2002 |
| JP | 2002-078036 | | 3/2002 |
| WO | WO 00/32865 | | 6/2000 |
| WO | WO 00/47808 | A1 | 8/2000 |
| WO | WO 01/28068 | A1 | 4/2001 |
| WO | WO 01/96644 | A1 | 12/2001 |
| WO | WO 01/96645 | A2 | 12/2001 |
| WO | WO 02/02857 | A1 | 1/2002 |

OTHER PUBLICATIONS

Abstract of Japanese Publication No. 2001-195119, Jul. 19, 2002.
International Search Report dated Apr. 4, 2003 for International Application No. PCT/JP02/13873.

* cited by examiner

*Primary Examiner*—Leo Picard
*Assistant Examiner*—Chad Rapp
(74) *Attorney, Agent, or Firm*—Pillsbury Winthrop Shaw Pittman, LLP

(57) ABSTRACT

A laundry system includes a home terminal device and laundry apparatus. The terminal device includes a first short-range communication device, a long-range communication device, and a terminal device controller transmitting information about laundry and a laundry constraint to a server connected to an Internet, thereby obtaining an operation control program for the laundry apparatus. The terminal device controller transfers the program via the first short-range communication device to the laundry apparatus and receives via the first short-range communication device information about an operating state of the laundry apparatus. The laundry apparatus includes a second short-range communication device, a laundry apparatus controller, and a laundry unit. The controller receives the program via the second short-range communication device from the terminal device to control the laundry unit and transfers the information about the operating state of the laundry apparatus via the second short-range communication device to the terminal device.

3 Claims, 29 Drawing Sheets

Bedding and bulk

| Clothing | | | Water level | Wash | | Rinse | | Dehydration | |
|---|---|---|---|---|---|---|---|---|---|
| | | | | Course | Time | Course | Time | Course | Time |
| Blanket | ~2.2kg | 1 | 40L | Setting blanket course (35 min., 3 times, 6 min. (preheating: 25 min.)) | | | | | |
| | ~3.0kg | 1 | 40L | | | | | | |
| Rugs and mats | | | 40L | Setting blanket course (35 min., 3 times, 6 min.) | | | | | |
| Curtain | ~2.0kg | 3 lace curtains | 40L | Setting blanket course (35 min., 3 times) | | | | Blanket | 3 min. |
| Towelket | | | 40L | Blanket | 15 min. | Blanket | Twice | Blanket | 6 min.(25) |
| Bed sheets, pillow cover and table cloth | ~2.0kg | 4 | 40L | Blanket | 15 min. | Blanket | Twice | Blanket | 3 min.(25) |
| | ~4.5kg | 9 | 40L | Blanket | 15 min. | Blanket | Twice | Blanket | 3 min. |

FIG.10A

Bedding and bulk

| Clothing | | | Drying | | |
|---|---|---|---|---|---|
| | | | Course | Time | setting |
| Blanket | ~2.2kg | 1 | Blanket | Automatic | – |
| | ~3.0kg | 1 | – | – | – |
| Rugs and mats | | | | | |
| Curtain | ~2.0kg | 3 lace curtains | | | |
| Towelket | | | Standard | Automatic | – |
| Bed sheets, pillow cover and table cloth | ~2.0kg | 4 | Standard | Automatic | Ironing |
| | ~4.5kg | 9 | – | – | – |

No additional drying

FIG. 10B

Everyday wear

| Clothing | | | Water level | Wash | | Rinse | | Dehydration | |
|---|---|---|---|---|---|---|---|---|---|
| | | | | Course | Time | Course | Time | Course | Time |
| Bath towel | ~ 2.1kg | Number: 7 | Automatic | Course: standard, time: automatic | | | | | |
| | ~ 4.2kg | Number: 14 | | | | | | | |
| Shirt | ~ 4.0kg | | Automatic | Course: standard, time: automatic | | | | Standard | 3 min. (automatic) |
| | ~ 7.0kg | | | | | | | Standard | 3 min. |
| T-shirt, Trainer, Polo shirt | ~ 4.0kg | | Automatic | Course: standard, time: automatic | | | | | |
| | ~ 7.0kg | | | | | | | | |
| Heavily soiled (training wear, working clothes, socks) | ~ 4.0kg | | Automatic | Course: strong, time: automatic | | | | | |
| | ~7.0kg | | | | | | | | |
| Diaper | ~4.0kg | | Automatic | Course: strong, time: automatic | | | | | |
| | ~7.0kg | | | | | | | | |

FIG. 11A

Everyday wear

| Clothing | | | Drying | | |
|---|---|---|---|---|---|
| | | | Course | Time | setting |
| Bath towel | ~ 2.1kg | Number: 7 | Standard | Automatic | Strong |
| | ~ 4.2kg | Number: 14 | – | – | – |
| Shirt | ~4.0kg | | Standard | Automatic | Ironing |
| | ~7.0kg | | – | – | – |
| T-shirt, Trainer, Polo shirt | ~4.0kg | | Standard | Automatic | Reducing shrinkage |
| | ~7.0kg | | – | – | – |
| Heavily soiled (training wear, working clothes, socks) | ~4.0kg | | Standard | Automatic | – |
| | ~7.0kg | | – | – | – |
| Diaper | ~4.0kg | | Standard | Automatic | Strong |
| | ~7.0kg | | – | – | – |

No additional drying

FIG. 11B

In use of powdered synthetic detergent

■Notices of use

Detergent sometimes remains in the detergent case at a house to which a small amount of water is supplied. Further, comply with the indication on a container of detergent when the detergent is supplied. An amount of detergent displayed sometimes differs depending upon a selected course even when an amount of clothes is the same.

52

| Amount of clothes | Displayed amount of detergent (by cup) |
|---|---|
| About 7 kg | 0.9 cups |
| About 4 kg | 0.6 cups |
| About 2 kg | 0.5 cups |
| About 1 kg | 0.3 cups |

Touch here when you desire to set.

s161

Operation control is set for powdered synthetic detergent d161 s162 d162

Return to previous screen

FIG.16

54

When noise-reduced operation is desired

■ Clothes which can be set

Optimum operation setting in a noise-reduced course is transmitted when clothes usually washed under standard course, such as ordinary clothes, have been set by the service for transmission of operation contents.

Touch here when you desire to set.

To be operated in noise-reduced course s181 d181

■ Notice

The noise-reduced course cannot be set when clothes are those for which the noise-reduced course is disallowed to be set. (The noise-reduced course need not be set in a drying course or blanket course since rotational speed for dehydration is low.

Return to previous screen s182 d182

FIG.18

63

Caution!

Operation contents have been altered from the contents set by the clothes washing service at the home laundry apparatus side.

Wash time has been changed from 5 min to 8 min. Soft clothes tend to be easily damaged. Put the clothes easy to be damaged into a washing net or wash them separately.

FIG.27

LAUNDRY SYSTEM INCLUDING HOME TERMINAL DEVICE AND LAUNDRY APPARATUS WITH COMMUNICATING FUNCTION

CROSS-REFERENCE TO RELATED APPLICATIONS

This application is the National Phase of International Application No. PCT/JP02/13873 filed Dec. 27, 2002, which designated the U.S. and was published on Jul. 31, 2003 as International Publication No. WO 03/062516 A1. That application is based upon and claims the benefit of priority from prior Japanese Patent Application No. 2002-13384 filed Jan. 22, 2002. The contents of both International Application No. PCT/JP02/13873 and Japanese Patent Application No. 2002-13384 are incorporated herein by reference.

BACKGROUND OF THE INVENTION

1. Field of the Invention

This invention relates to a laundry system including a home terminal device communicating via an Internet or the like with a server storing and providing a database which is a large collection of data of optimum operating conditions for laundry apparatus and a laundry apparatus communicating with the terminal device.

2. Description of the Related Art

Almost all the conventional laundry apparatus such as automatic washing and drying combination machines, automatic washing machines and automatic dryers include respective microcomputers for controlling operations of the laundry apparatus. Each such microcomputer includes a memory on which a multiple of operation control programs corresponding to a multiple of operating (or washing and/or drying) conditions are previously stored. When a user operates an operation panel to set desired operating conditions prior to the start of laundry, an operation control program corresponding to the set operating conditions is read out from the memory, and the operation of the laundry apparatus is controlled on the basis of the read operation control program.

Recently, various types of clothes have been produced using various types of fibers and the number of types of detergents have also been increased. With increase in the types of fibers and detergents, users have had difficulties in setting optimum operating conditions suitable for the various conditions. As a result, unsuitable operating conditions have been set in the laundry apparatus, whereupon the laundry undergoes damage and/or shrinkage or results in inconveniences such as allergy.

Furthermore, in the foregoing case where the memory provided in the laundry apparatus previously stores the multiple of operation control programs, it is difficult to add a new operation control program corresponding to new clothes woven of a new fiber or to new types of detergents.

SUMMARY OF THE INVENTION

Therefore, an object of the present invention is to provide a laundry system in which an optimum operating condition determined in consideration of types of clothes, types of detergents, etc. can be set without the user relying upon his or her experiences and intuition and laundry can be carried out under a set optimum operating condition.

The laundry system of the present invention operates on the premise that a server exists which provides laundry control information and stores a database storing and providing various pieces of information about laundry such as types of clothes, types of detergents, possible combinations of types of clothes and detergents, and an operation control program of the laundry apparatus to realize an optimum operation corresponding to the foregoing combination.

The present invention provides a laundry system comprising a terminal device and laundry apparatus. The terminal device includes a display panel, input panel, first short-range communication device, long-range communication device, and terminal device controller. The terminal device controller controls the input panel and the display panel. The terminal device controller further controls the long-range communication device to transmit an inquiry via the long-range communication network such as the Internet or wireless telephone to the server and to receive a reply to the inquiry. The terminal device controller further controls the first short-range communication device to transmit necessary information to the laundry apparatus by means of Bluetooth wireless communication or a short-range communication network such as wireless LAN and to receive information about an operating state of the laundry apparatus.

The laundry apparatus includes an operation panel, a second short-range communication device, a laundry apparatus controller and a laundry (washing and/or drying) unit. The laundry apparatus controller receives the operation control program via the second short-range communication device from the terminal device thereby to control the laundry unit so that laundry is washed and/or dried. The laundry apparatus controller further transmits the information about the operating state of the laundry apparatus via the second short-range communication device to the terminal device.

The user operates the input panel of the terminal device to input a type of clothes, a type of detergent to be used, a desired incidental condition (laundry option), etc. The terminal device transmits input conditions to the server and receives an optimum operation control program meeting the conditions from the server. The terminal device further transmits the received program to the laundry apparatus controller. The laundry apparatus controller controls the laundry unit according to the received operation control program so that clothes are washed and/or dried. The laundry apparatus controller further transmits the information about the operating state of the laundry apparatus and results of operation to the terminal device. Thus, washing and/or drying the laundry is carried out as the result of the foregoing operation. Consequently, the user can get an optimum result of laundry for the clothes with an easy operation without relying upon his or her experiences and intuition.

BRIEF DESCRIPTION OF THE DRAWINGS

Other objects, features and advantages of the present invention will become clear upon reviewing the following description of the embodiment, with reference to the accompanying drawings, in which:

FIGS. 10A and 10B show an operation control program corresponding to "bedding and bulk" which is a list of minor group clothes;

FIGS. 11A and 11B show an operation control program corresponding to "everyday clothes" which is one of the minor group clothes;

FIG. 16 shows a screen indicative of "under use of powdered synthetic detergent";

FIG. 18 shows a screen indicative of "case where noise-reduced operation is desired";

FIG. 27 shows a screen indicative of "caution".

DETAILED DESRIPTION OF THE INVENTION

Figure 1:
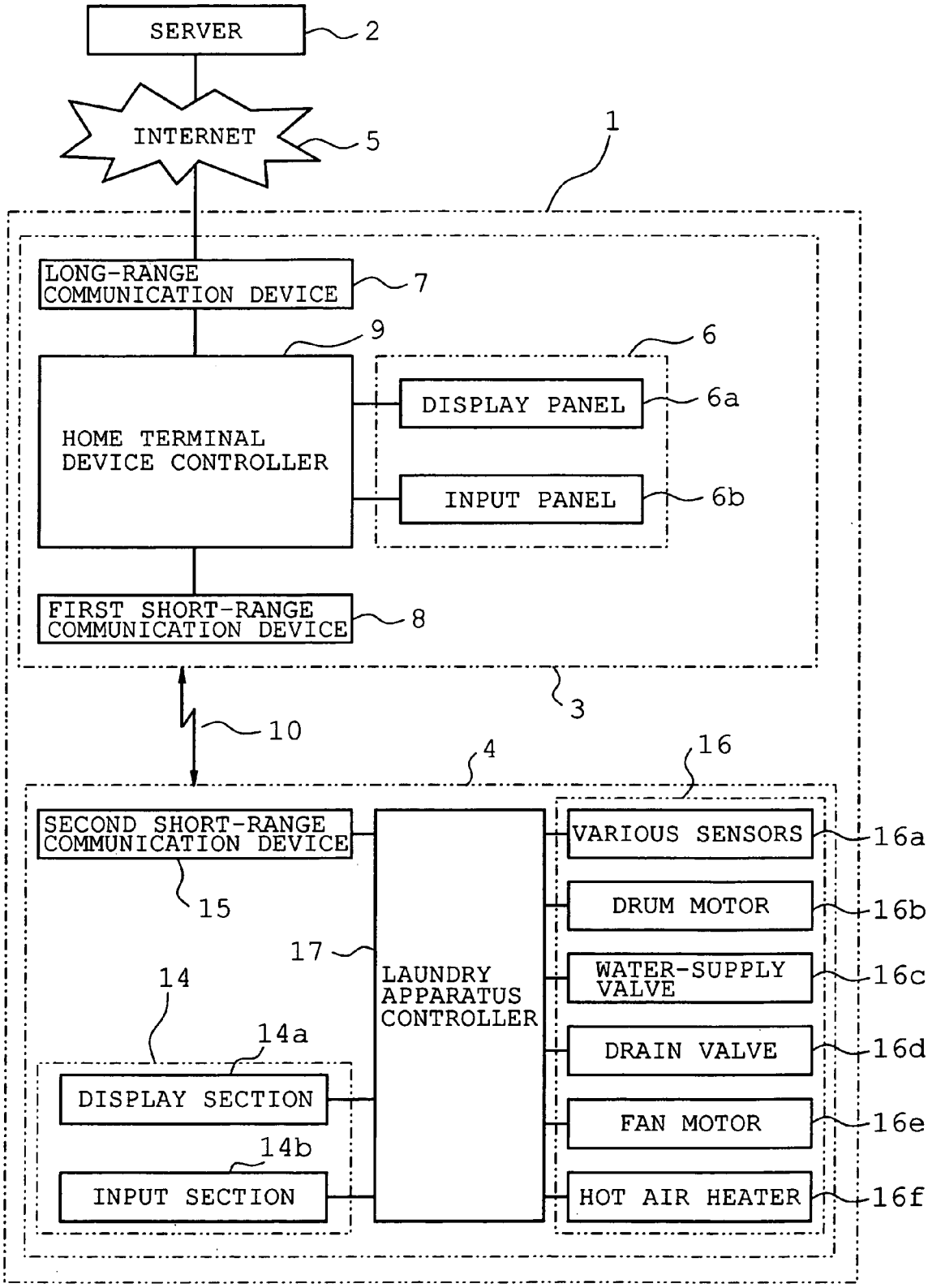
FIG. 1 is a block diagram of the laundry system of one embodiment in accordance with the present invention, together with a server.

One embodiment of the present invention will be described with reference to the accompanying drawings. Referring to FIG. 1, an overall hardware arrangement of a laundry system 1 in accordance with the invention is shown as connected via the Internet to a server 2 providing laundry control information. The laundry system 1 comprises a home terminal device 3 and a laundry apparatus 4. The laundry system 1 operates on the premise that the server 2 has already been established. The server 2 is connected to a long-range communication network such as an Internet 5 or wireless telephone network. The server 2 is provided with a laundry control information database (hereinafter, "database") storing comprehensive information about laundry general and control of laundry apparatus. The database comprises a relational database, for example and is managed by a relational database management system (RDBMS). When receiving an inquiry about laundry from the terminal device 3, the server 2 retrieves the database to extract a reply from the database by means of RDBMS, providing the reply to the terminal device 3, as will be described later.

The database stores information about types of clothes and used fibers, information about detergents, combined information about types of clothes and types of detergents allowed to be used, combined information about clothes unsuitable for washing them with other types of clothes, information about preparation prior to laundry, information about notices regarding laundry, information about allergy to detergent, information about clothes allowed to be added during washing, information about optimum laundry conditions corresponding to clothes and detergents to be used, an optimum operation control program of laundry apparatus corresponding to each laundry condition, and an operation control program for an operation with noise reduction. Installation of the server 2 and renewal of database are usually carried out by a manufacturer of the laundry apparatus.

The terminal device 3 includes a display panel 6*a*, an input panel 6*b*, a long-range communication device 7, a first short-range communication device 8 and a terminal device controller 9. The long-range communication device 7 accesses the server 2 via a long-range communication network such as the Internet 5 or a wireless telephone network. The first short-range communication device 8 transmits and receives information to and from the laundry apparatus 4 via a short-range communication network such as wireless communication by means of Bluetooth or wireless LAN.

Figure 2:
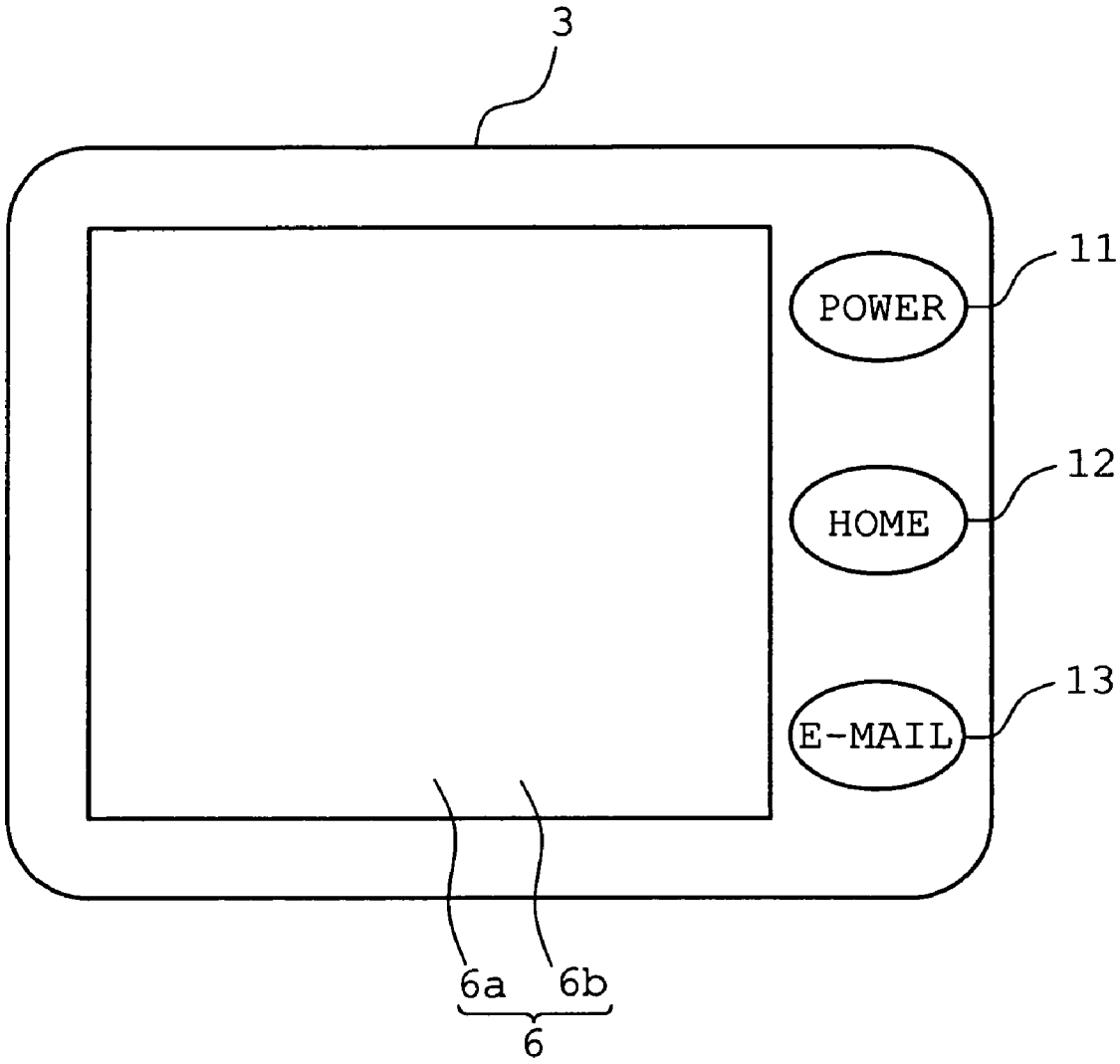
FIG. 2 is a front view of a terminal device.

The display panel 6*a* and the input panel 6*b* serve as a man-machine interface between the terminal device 3 and the user. Referring to FIG. 2, the terminal device 3 includes a liquid-crystal touch panel 6 serving both as the display panel 6*a* and as the input panel 6*b*. The terminal device 3 further includes a "power" switch 11 and a "home" switch 12 which is operated to call a menu screen of the terminal device 5.

Figure 3:
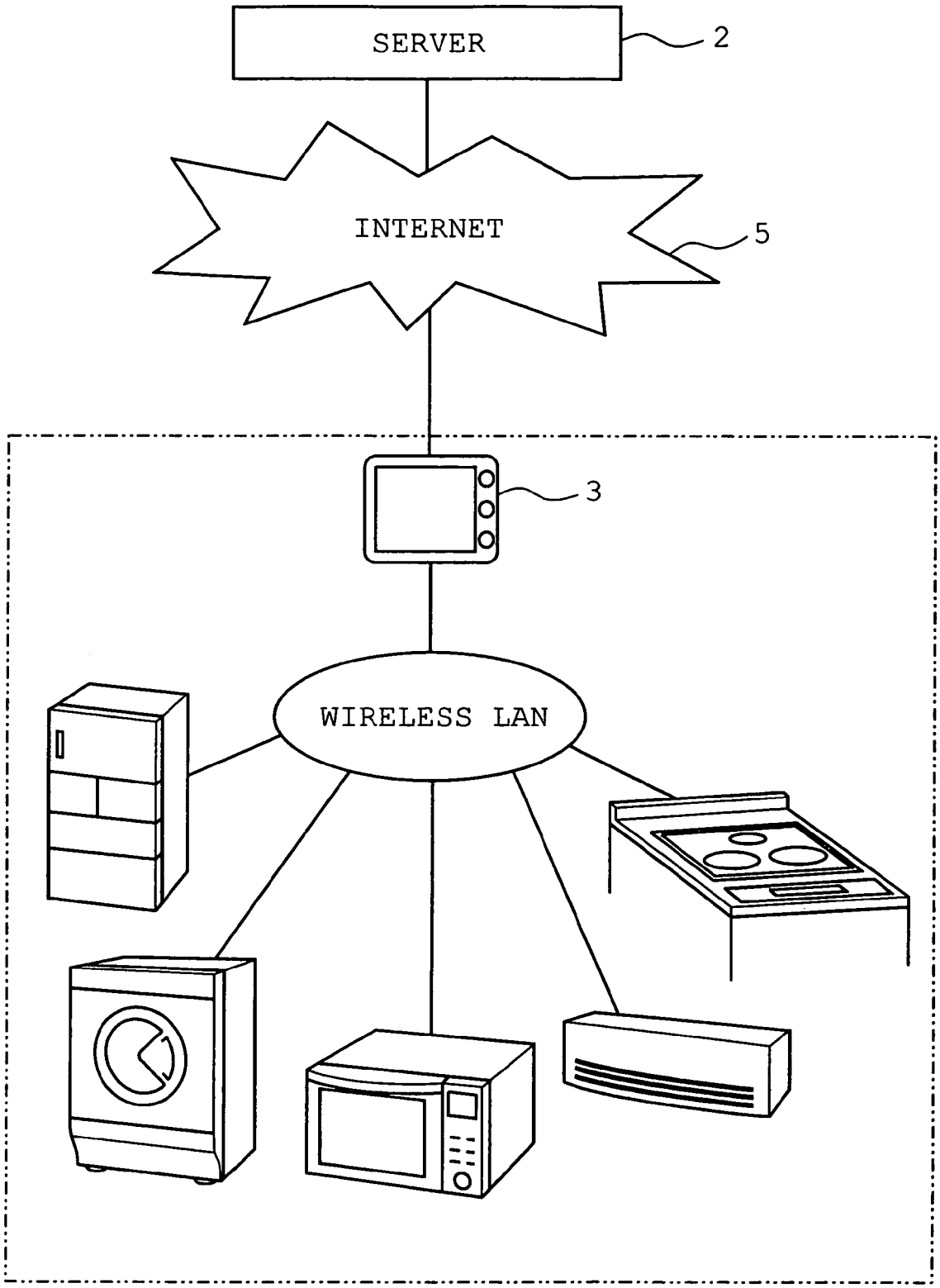
FIG. 3 illustrates a case where the terminal device is used as common to various household electric appliances.

The terminal device controller 9 controls the overall terminal device 3. Since the single terminal device 3 incorporates a microcomputer (not shown), it may serve for other household control systems such as a refrigerator system, microwave oven system, air-conditioner system as well as for the laundry system 4. Furthermore, the single terminal device 3 may serve for a plurality of laundry systems. FIG. 3 schematically illustrates a case where the terminal device is used as common to various household electric appliances. Additionally, the terminal device 3 may have an e-mail function.

The laundry apparatus 4 may be an automatic washer-drier, automatic washing machine, automatic drier, etc. The laundry apparatus 4 is an automatic washer-drier in the embodiment. Where the laundry apparatus 4 is applied to an automatic washing machine or an automatic drier, one or more unnecessary functions may be eliminated from those of the apparatus 4 which will hereinafter be described. The laundry apparatus 4 comprises an operation panel 14 including a display section 14*a* and an input section 14*b*, a short-range communication device 15, a laundry (washing and/or drying) unit 16 and a laundry apparatus controller 17. The laundry unit 16 is directly related to clothes washing and drying operations and comprises various sensors 16*a*, a drum motor 16*b*, a water-supply valve 16*c*, a drain valve 16*d*, a fan motor 16*e*, a warm air heater 16*f*, a drum (not shown), a water-supply hose, etc. Various sensors 16*a* include a water-level sensor, a temperature sensor and a weight sensor. The short-range communication device 15 is provided for communication with the terminal device 3.

The laundry apparatus controller 17 includes a microcomputer (not shown) and controls an overall operation of the laundry apparatus 4. The operation panel 14 serves as a man-machine interface between the terminal device 3 and the user. The laundry apparatus 4 is arranged so that a user can directly set laundry conditions on the operation panel 14 for the running of the laundry apparatus 4 when no terminal device 3 is provided or when the terminal device 3 has failed.

Figure 4:
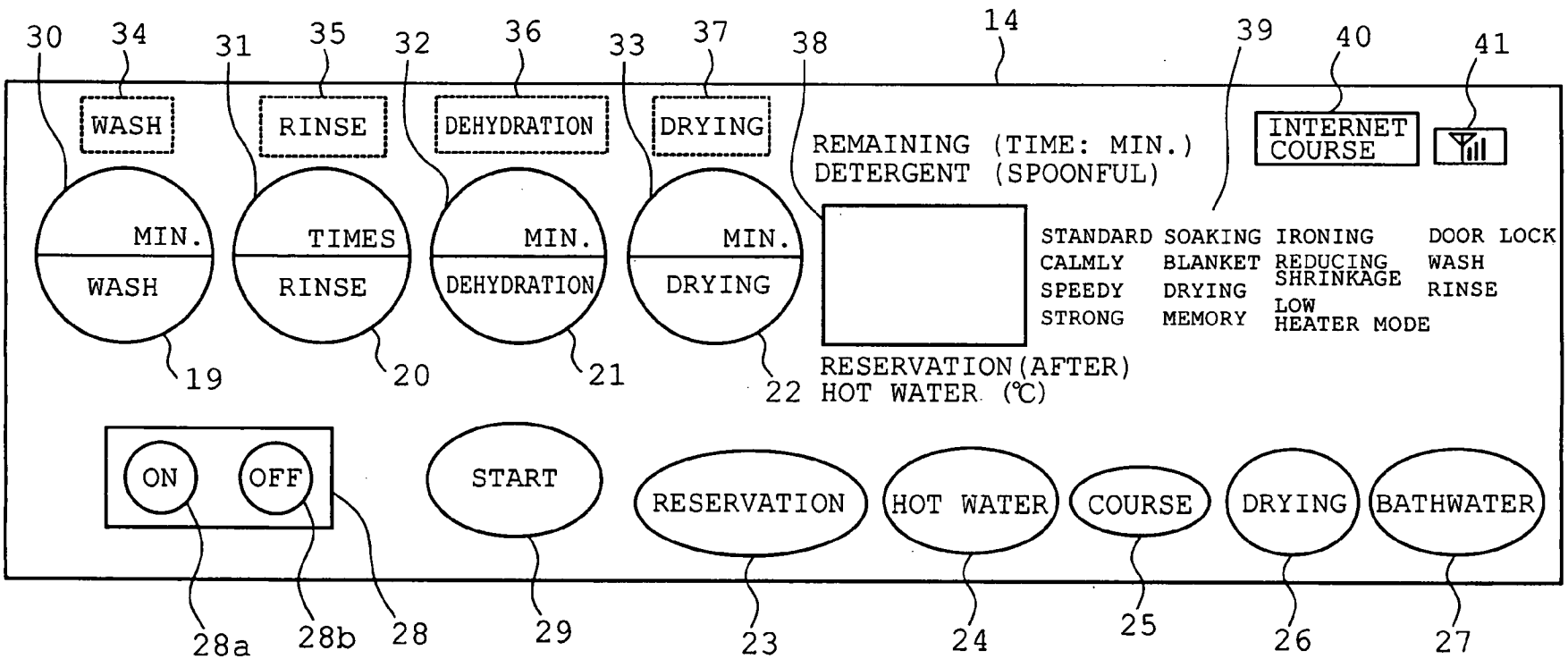
FIG. 4 illustrates an operation panel of a laundry apparatus.

Referring now to FIG. 4, the operation panel 14 of the laundry apparatus 4 is shown. The operation panel 14 includes a wash time setting switch 19, a rinse setting switch 20, a dehydration time setting switch 21, a drying time setting switch 22, a reservation setting switch 23, a hot water setting switch 24, a course setting switch 25, a drying setting switch 26, a bathwater setting switch 27, all of which are provided for setting laundry conditions, and a power switch 28 and a start switch 29.

The operation panel 14 includes a wash time display 30, a rinse time display 31, a dehydration time display 32, a drying time display 33, a wash step display 34, a rinse step display 35, a dehydration step display 36, a drying step display 37, a display 38 for a remaining time or detergent quantity, a display 39 for various courses, an internet course display 40 displaying that the operation is based on the operation control program from the server 2, and a "communication" display 41 displaying that the laundry apparatus 4 is under communication with the terminal device 3, all of which display the operating state of the laundry apparatus.

Figure 5:
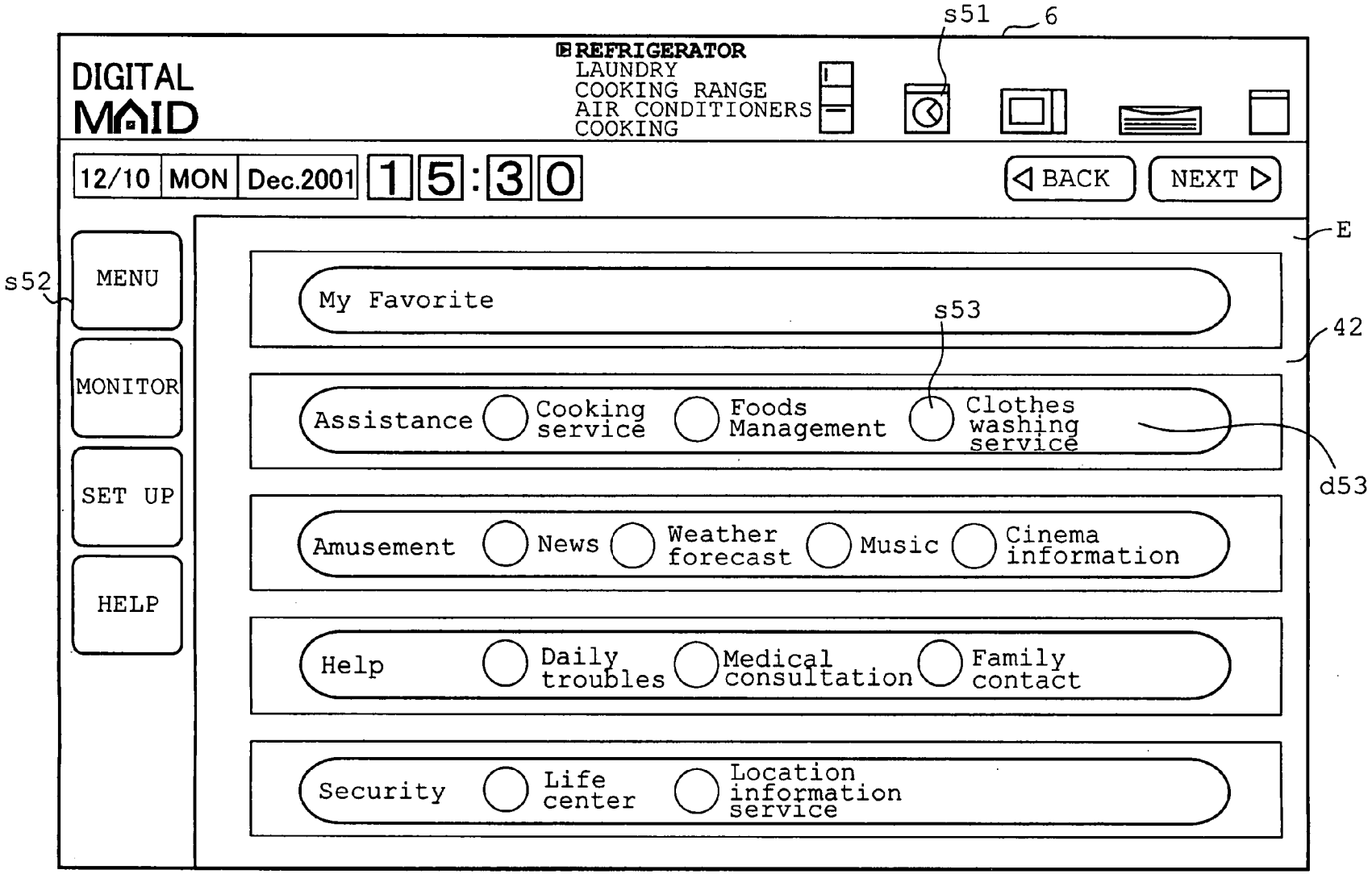
FIG. 5 illustrates a menu screen of the terminal device.

The operation of the laundry system 1 will now be described. When the user turns on the power switch 11 of the terminal device 3, the terminal device controller 9 displays a screen as shown in FIG. 5 on the touch panel 6. A terminal menu screen 42 is displayed on a section E. Various screens are displayed on the section E of the touch panel 6. The portion of the touch panel 6 other than the section E is a fixed screen which is not switched and is not directly related with the operation of the laundry system except for the upper monitor switch s51. The screen as shown in FIG. 5 can be re-displayed every time the switch 12 as shown in FIG. 2 is touched during an ON-state of the power supply of the terminal device 3. Furthermore, the terminal menu screen 42 can also be re-displayed every time a menu switch s52 is touched.

The terminal menu screen 42 displayed on the section E as shown in FIG. 5 is used commonly as terminal devices of other systems. Accordingly, switches and displays for the other systems are provided. The terminal menu screen 42 includes a washing service switch s53 and a display d53 both related with the laundry system 1.

Figure 6:
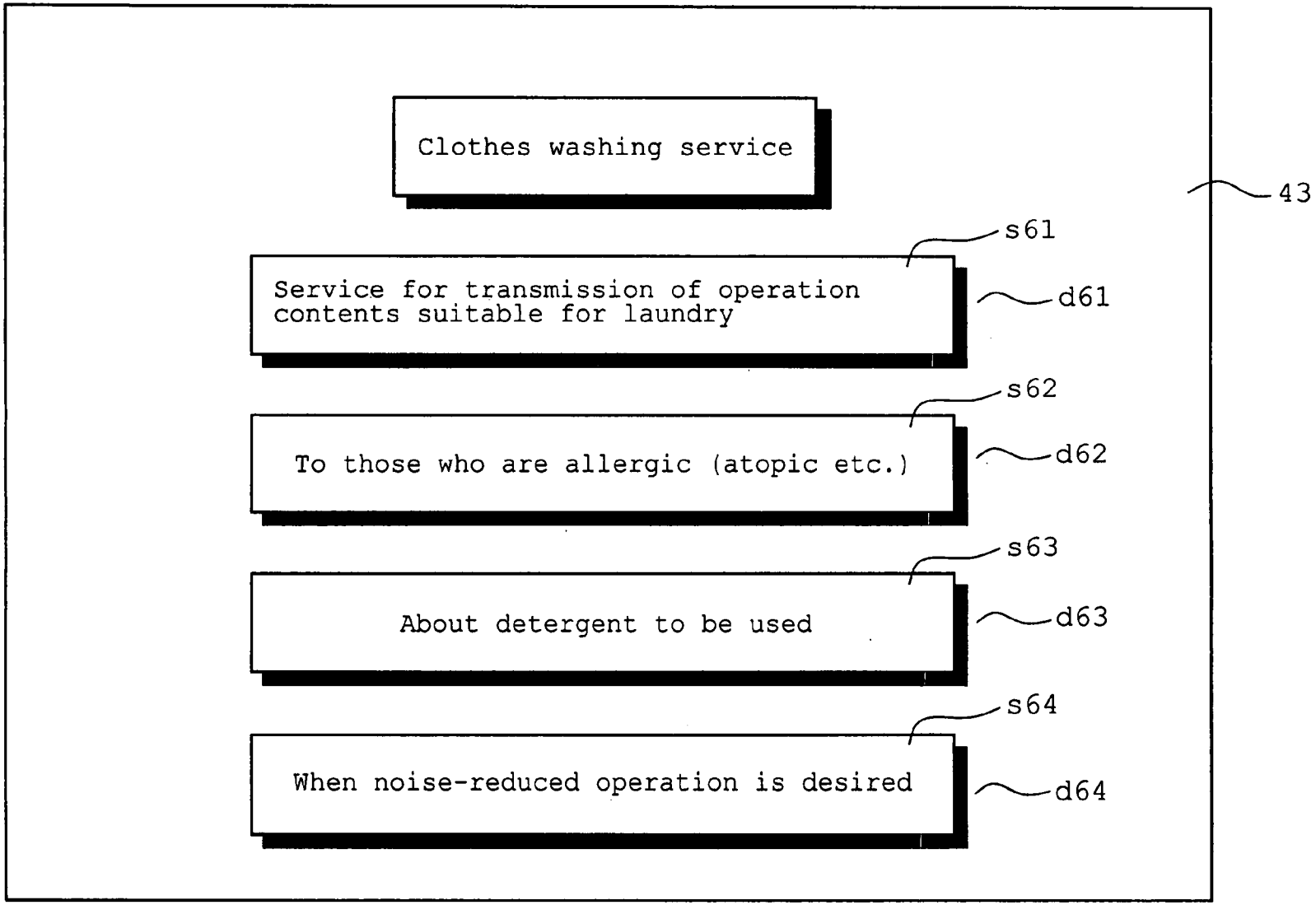
FIG. 6 illustrates a "washing service" screen which is a menu screen for the laundry system.

The user firstly touches the "washing service" switch s53 in order that the washing may be started. Then, the terminal device controller 9 obtains from the server 2 a "washing service" screen 43 as shown in FIG. 6, displaying the screen on the section E of the touch panel 6. The "washing service" screen 43 corresponds to a menu screen of the laundry system 1. Menus of the laundry system 1 include a first menu of "service for transmission of operation contents suitable for laundry," a second menu of "to those who are allergic (atopic etc.)," a third menu of "about used detergent" and a fourth menu of "when noise-reduced operation is desired." Switches s61 to s64 and displays d61 to d64 are provided so as to correspond to the menus respectively.

The contents of each menu will now be described. The first menu is provided for designating clothes to be washed, obtaining an optimum operation control program for the clothes, and transmitting the program to the laundry apparatus 4. The other three menus are provided for designating constraints necessary when the server 2 retrieves and determines optimum operating conditions. The constraints will hereinafter be referred to as "laundry constraints."

Figure 7:
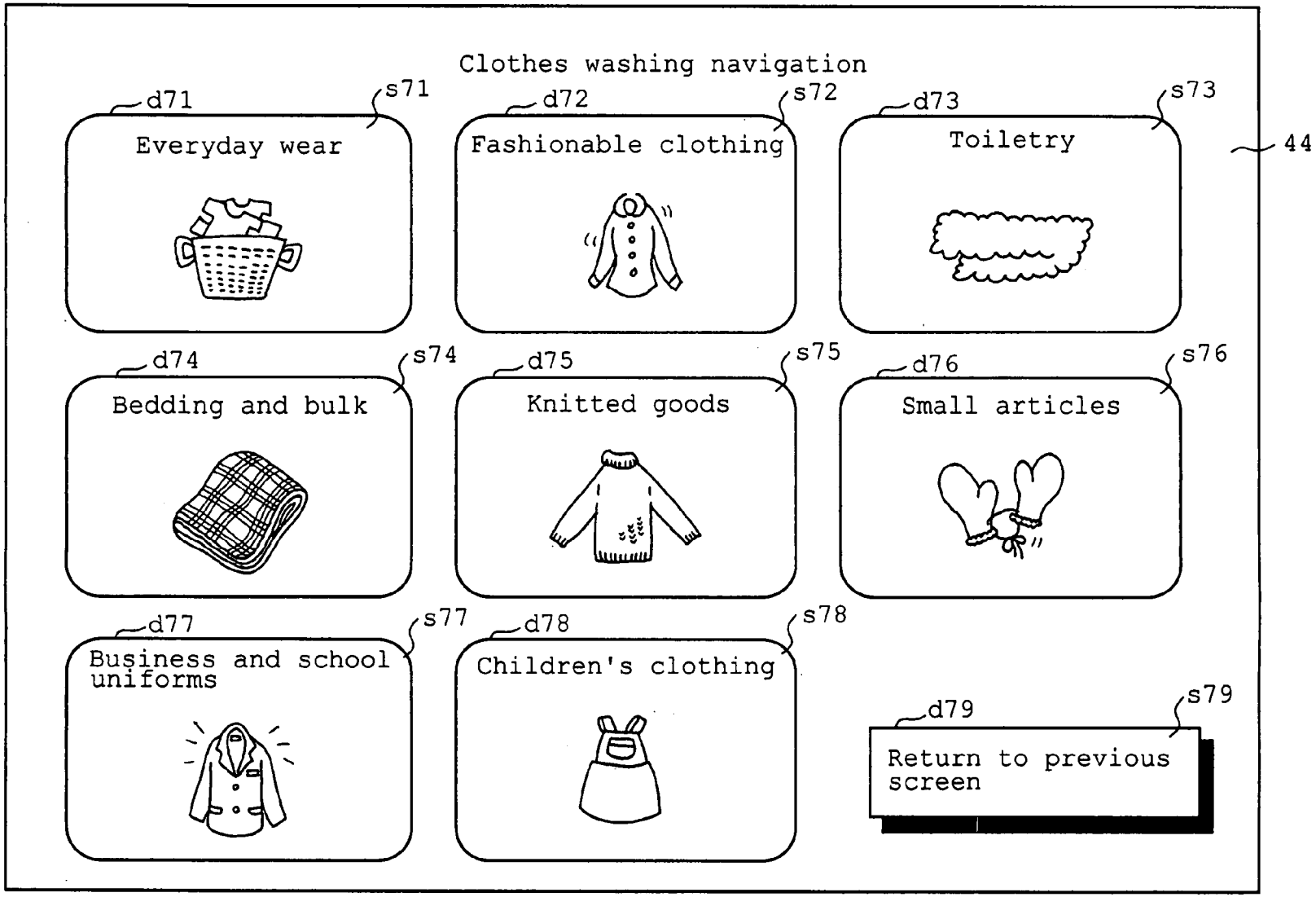
FIG. 7 illustrates a "washing navigation" screen which is a list of major group clothes.
Figure 8:
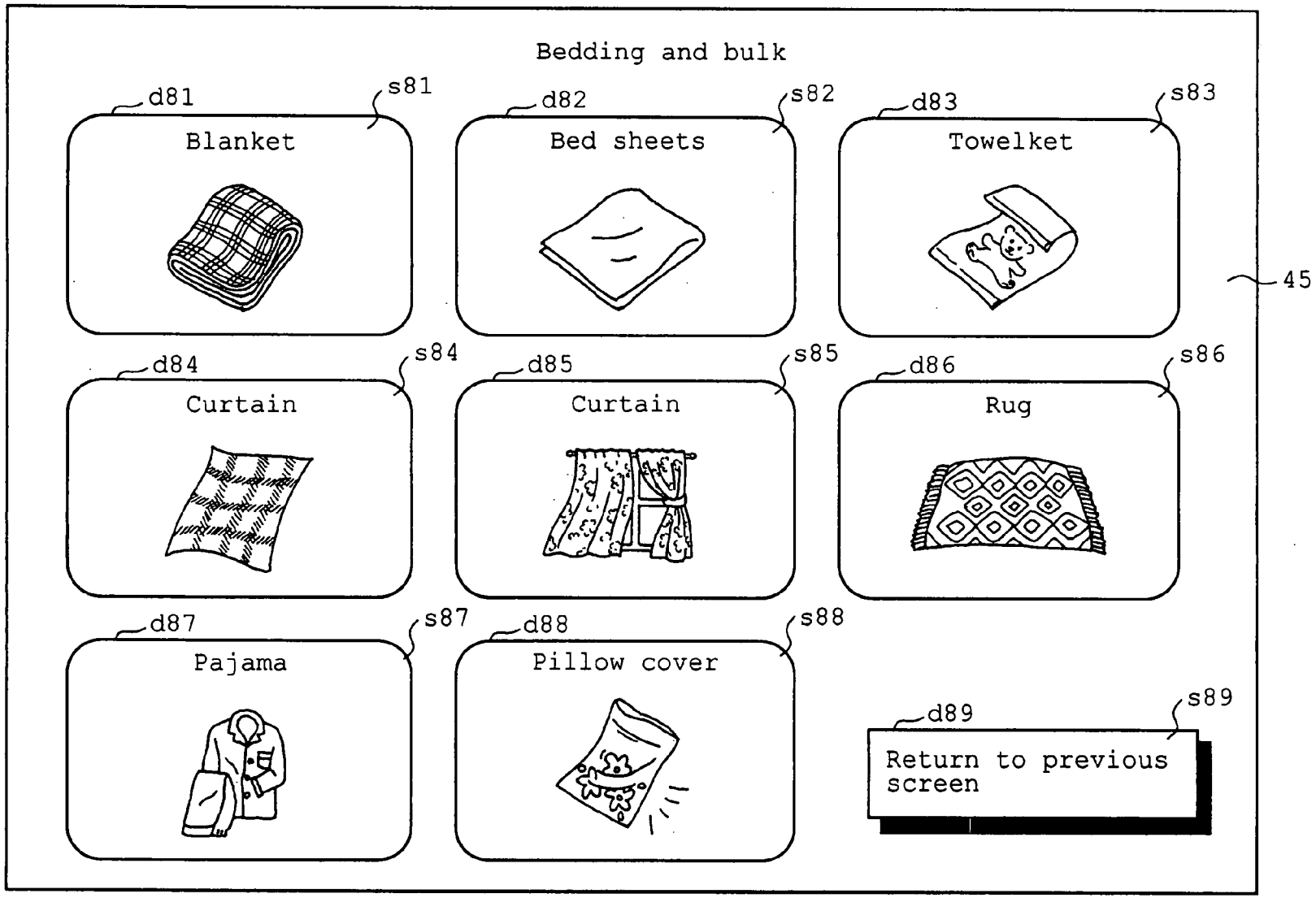
FIG. 8 illustrates a "bedding and bulk" screen which is a list of minor group clothes.

Firstly, the operation will be described in a case where no laundry constraints are designated. The user first touches the switch s61 corresponding to the menu, "service for transmission of operation contents suitable for laundry." The terminal device controller 9 then obtains a "washing navigation" screen 44 as shown in FIG. 7 from the server 2, displaying the screen on the touch panel 6. The "washing navigation" screen 44 provides major groups of clothes to be washed. The screen 44 in FIG. 7 exemplifies eight major groups corresponding to respective switches s71 to s78 and respective display sections d71 to d78. The user selects one of the major groups to which clothes to be washed belong, touching a switch corresponding to the selected major group. For example, when the user touches the switch s74 corresponding to the major group of "bedding and bulk," the terminal device controller 9 obtains from the server 2 a screen 45 indicative of minor groups corresponding to the selected major group, displaying the obtained screen on the touch panel 6 as shown in FIG. 8 exemplifying a case where the selected major group includes eight minor groups corresponding to respective switches s81 to s88 and respective display sections d81 to d88.

Figure 9:
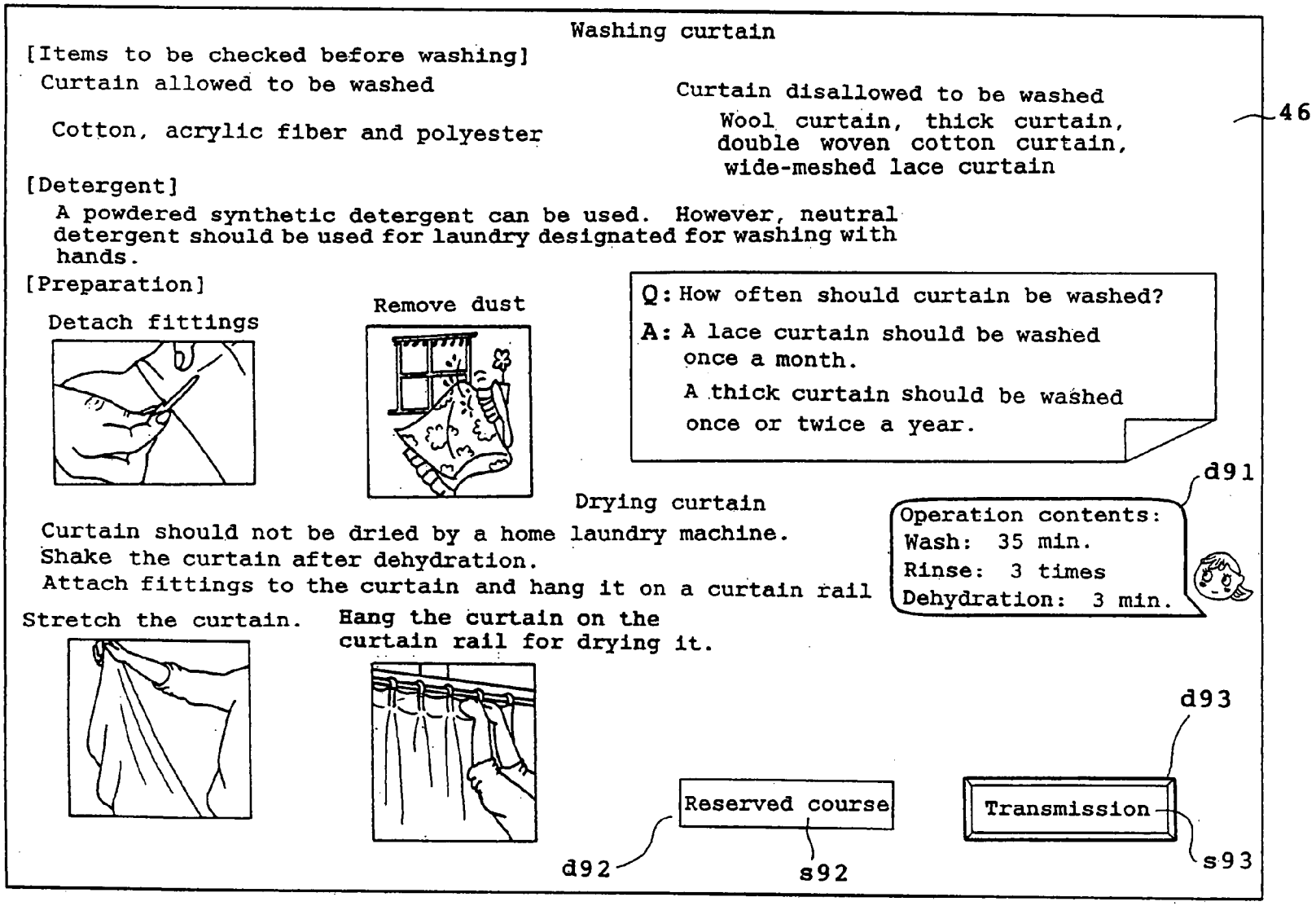
FIG. 9 illustrates a "washing curtain" screen corresponding to a "curtain" which is one of the minor group clothes.

The user then selects one of the eight minor groups displayed on the screen 45, touching a switch corresponding to the selected minor group. For example, when a "curtain" switch s85 has been selected, the terminal device controller 9 obtains from the server 2 a screen 46 of "curtain washing" corresponding to the minor group of "curtain," displaying the obtained screen 46 on the touch panel 6 as shown in FIG. 9. The "curtain washing" screen 46 displays guide information containing notices, preparation, recommended detergent, etc. Thus, the screen 46 serves as a guide-information screen providing guide information regarding washing of the selected minor group. A "reserved course" switch s92 is provided on the lower part of the screen 46. When the switch s92 is touched, a screen (not shown) on which a desired finish time is set is displayed. When the finish time is set, a start time of the laundry apparatus 4 is automatically adjusted so that the operation of the laundry apparatus is finished at the set finish time.

The user then touches a "transmission" switch s93 on the "curtain washing" screen 46 after completion of setting regarding the clothes to be washed. The terminal device controller 9 then transmits information of the selected major and minor groups to the server 2 using the long-range communication device 7. The server 2 retrieves from the database an optimum operation control program corresponding to the clothes of the received minor group, transmitting the program to the terminal device controller 9. FIGS. 10A, 10B, 11A and 11B illustrate examples of operation control programs the server 2 transmits to the terminal device controller 9 respectively. FIGS. 10A and 10B illustrate an operation control program for all the clothes of the minor group belonging to the major group of "bedding and bulk." FIGS. 11A and 11B illustrate an operation control program for all the minor group clothes belonging to the major group of "everyday clothes." However, only an operation control program for the selected clothes of the minor group is actually transmitted. Accordingly, when "curtain" has been selected, only the washing conditions for "curtain" in FIGS. 10A and 10B are transmitted to the terminal device controller 9.

Each of FIGS. 10A, 10B, 11A and 11B includes one or more minor groups in each of which two operation control programs are prepared depending upon the weight of clothes. Regarding these minor groups, two operation control programs are transmitted to the laundry apparatus 4. The weight sensor of the laundry apparatus 4 measures the weight of the clothes put into the laundry apparatus. Which of the two programs is employed is determined on the basis of the result of measurement. The terminal device controller 9 temporarily stores the received operation control program for "curtain" in an internal memory and then displays major groups of the received operation control program on an operation condition display section d91 of the screen 46 of "curtain washing."

Figure 12:
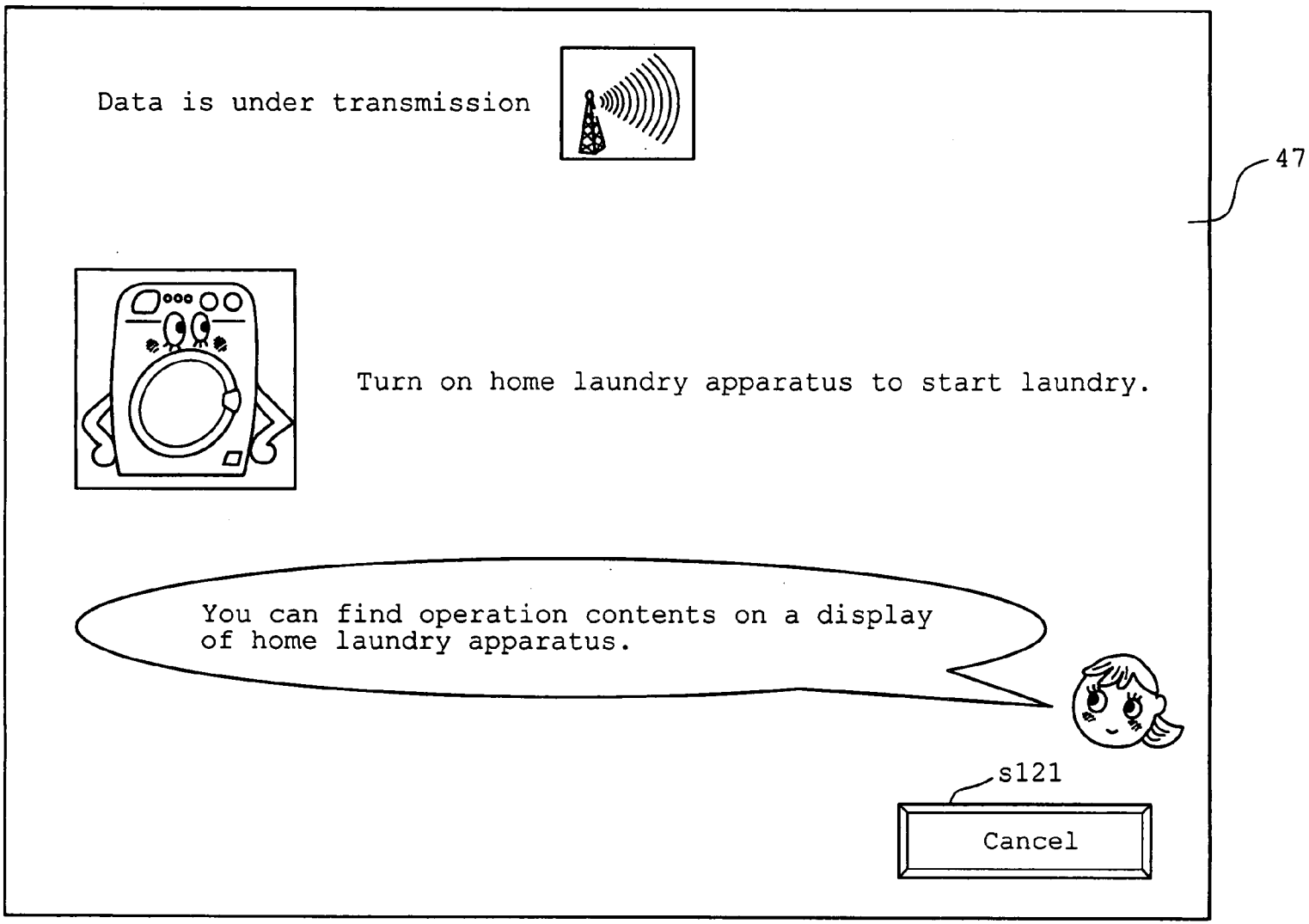
FIG. 12 shows a screen of "under transmission"

The terminal control device 9 then displays a screen 47 of "under transmission" as shown in FIG. 12 on the touch panel 6. The screen 47 urges the user to turn on the laundry apparatus and to depress the start switch 29. Power is supplied to all the devices of the laundry apparatus 4 when the user depresses the ON switch 28*a* of the power switch 28, following the instructions of the screen 47. The laundry apparatus controller 17 informs the terminal control device 9 of turn-on of the laundry apparatus 4, using the short-range communication device 15. In this case, it is preferable to inform of the type name and type number of the laundry apparatus as well as turn-on of the laundry apparatus. When receiving the information of turn-on of the laundry apparatus 4, the terminal control device 9 transmits an operation control program for the stored minor group of "curtain" to the laundry apparatus 4.

The laundry apparatus controller 17 transmits the received operation control program to the operation panel 14 as shown in FIG. 4. Following the contents of the operation control program, the controller 17 turns on the corresponding ones of the display sections d30 to d40 of the operation panel 14 or displays numerals on the corresponding display sections.

When the user depresses the start switch 29 in the aforesaid condition, the controller 17 starts controlling the laundry unit 16 on the basis of the received operation control program, so that a wash step is initiated. However, when a desired finish time has been set by the use of a "reserved course" switch 92*a* as described above, an actual start of the operation is delayed to a time obtained by subtracting a required laundry time period from the desired finish time.

Figure 13:
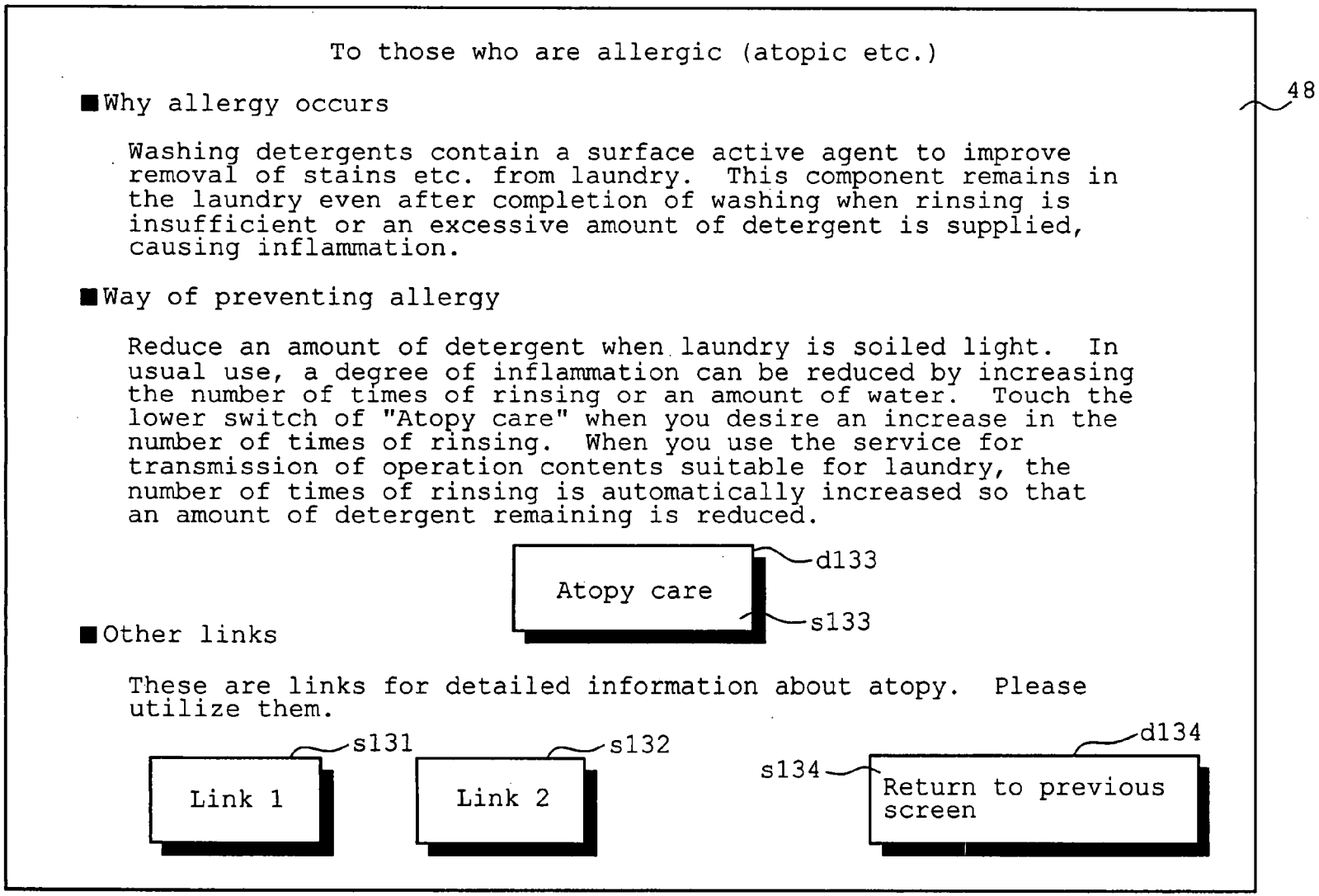
FIG. 13 shows a screen indicative of "to those who are allergic (atopic etc.)"

The following describes a case where laundry is initiated with the laundry constraints designated. Firstly, a case will be described where the menu of "to those who are allergic (atopic etc.)" has been selected on the "washing service" screen 43 (menu screen of laundry system 1) as shown in FIG. 6. When the user touches the switch s62, the terminal control device 9 obtains the screen 48 of "to those who are allergic (atopic etc.)" as shown in FIG. 13 from the server 2, displaying the obtained screen on the touch panel 6. Pieces of guide information such as "why atopy occurs," "way of preventing atopy," etc. are displayed on an upper part of the screen 48. A lower part of the screen 48 is provided with a LINK 1 switch s131 and a LINK 2 switch s132. When each switch is touched, more detailed guide information about atopy is obtained from the server 2 to be displayed on the touch panel 6.

Figure 14:
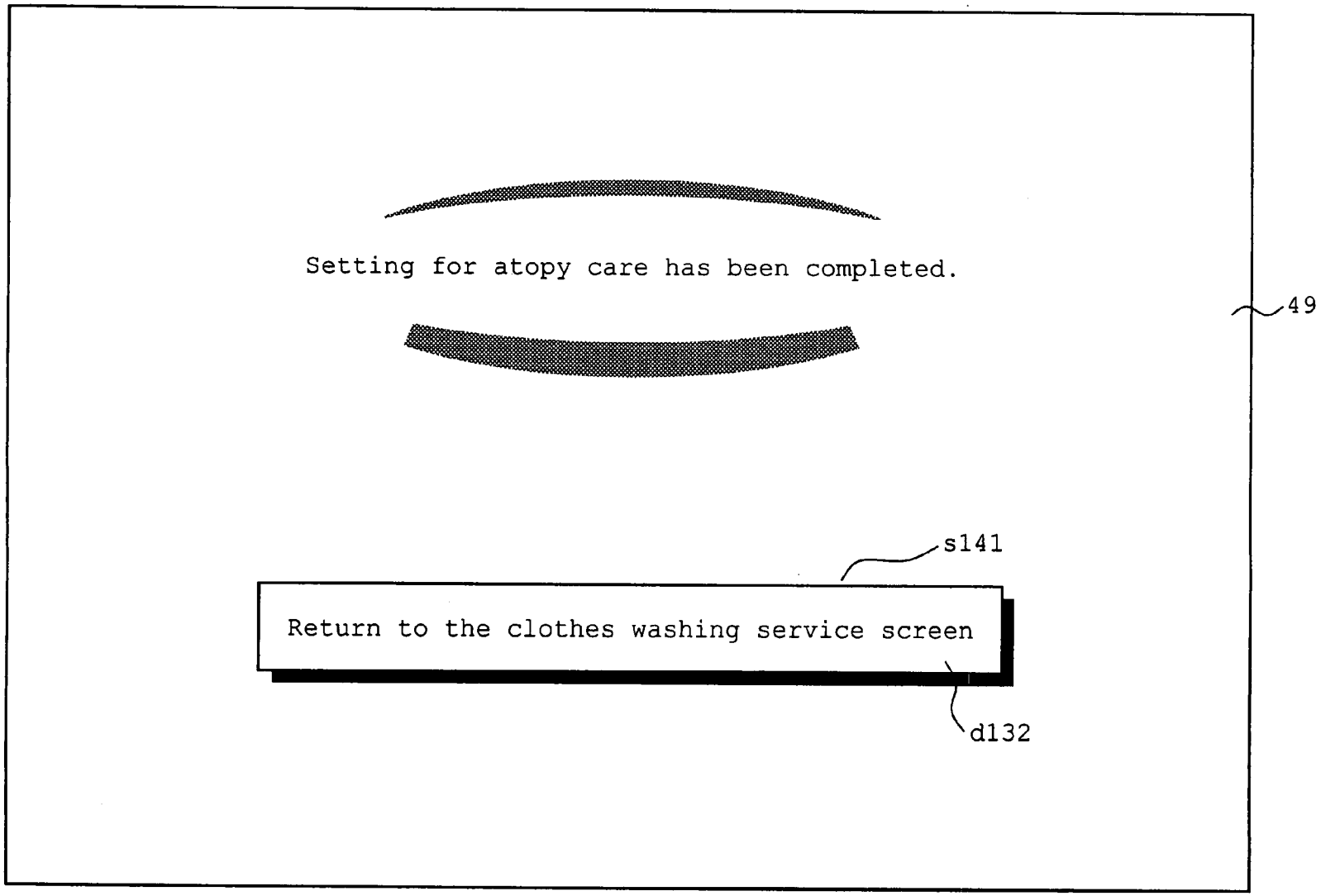
FIG. 14 shows a screen indicative of "setting of atopy care has been completed"

A central part of the screen 48 is provided with an "atopy care" switch s133 and a corresponding display section d133. The switch s133 is selected when the user desires a washing manner which tends not to cause atopy. A constraint of "atopy care" is set and the terminal controller 9 stores information that the constraint of "atopy care" has been set. At the same time, a screen 49 of "setting for atopy care has been completed" as shown in FIG. 14 is displayed, displaying that setting constraint of "atopy care" has been completed. When the aforesaid "transmission" switch s93 is touched with the constraint of "atopy care" set, the terminal controller 9 transmits to the server 2 information that the constraint of "atopy care" (when constraints of "setting of used detergent" and "noise-reduced course" have been set as will be described later, these pieces of information are included) has been set in addition to information about selected major and minor groups. When retrieving from the data base an optimum operation control program corresponding to the received minor group of clothes, the server 2 retrieves and determines an optimum operation control program in consideration of the set constraint of "atopy care" (when constraints of "setting of used detergent" and "noise-reduced course" have been set, these pieces of information are included), then transmitting it to the terminal controller 9. When the option of "atopy care" is set, an operation control program retrieved and determined contains a larger number of times of rinsing and a larger amount of water than when the option of "atopy care" is not set.

Figure 15:
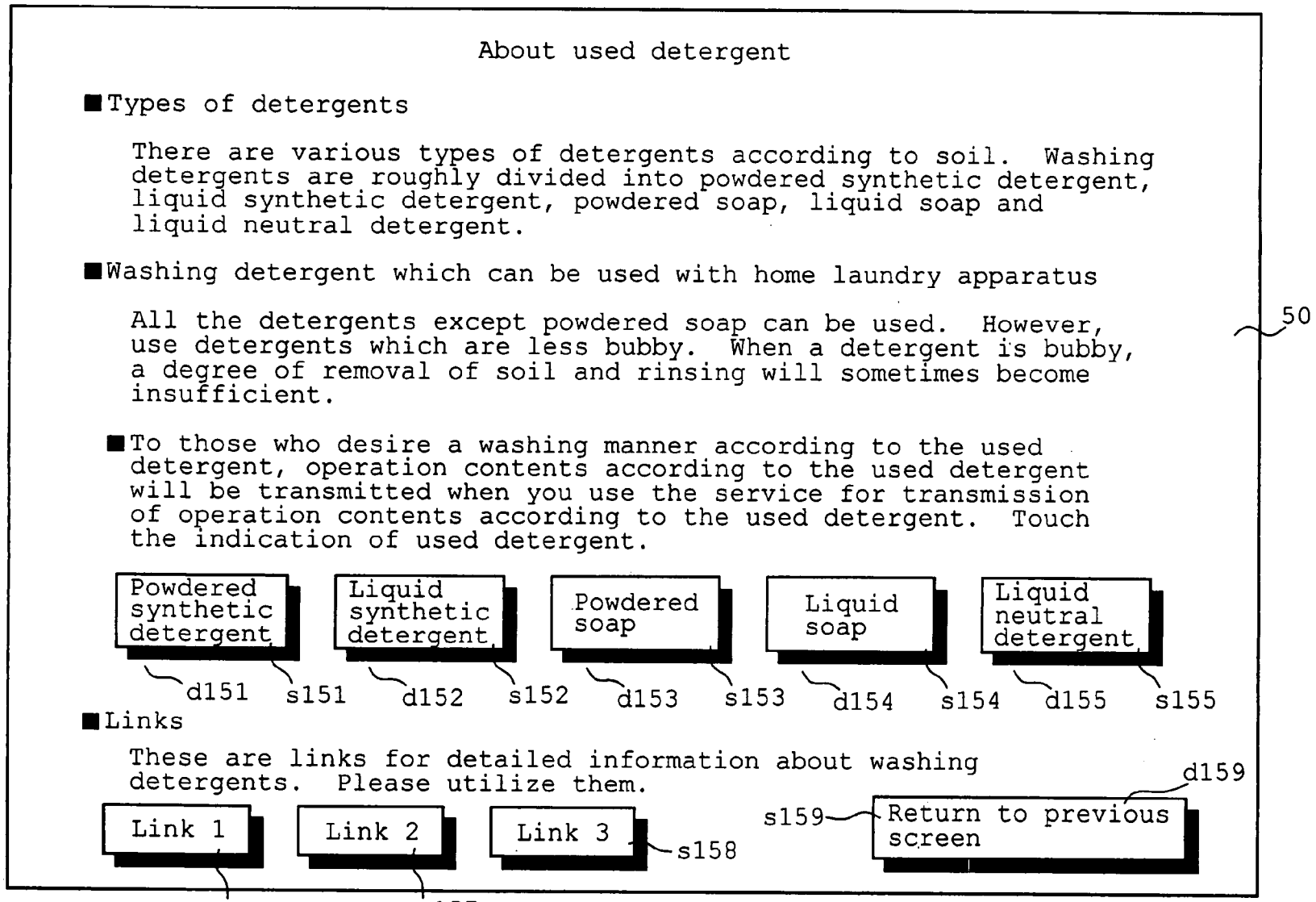
FIG. 15 shows a screen indicative of "about used detergent"

Next, a case will be described where the menu of "about used detergent" has been selected on the washing service screen 43 (menu screen of laundry system 1) as shown in FIG. 6. When the user touches the switch s63, the terminal controller 9 obtains the screen 50 of "about used detergent" as shown in FIG. 15 from the server 2, displaying the obtained screen on the touch panel 6. Pieces of guide information such as "types of detergents, detergent usable for home laundry," etc. are displayed on an upper part of the screen 50. A lower part of the screen 50 is provided with a LINK 1 switch s156, a LINK 2 switch s157 and a LINK 3 switch s158. When each switch is touched, more detailed guide information about used detergent is obtained from the server 2 to be displayed on the touch panel 6.

The screen 50 includes in its central part a "powdered synthetic detergent" switch s151, "liquid synthetic detergent" switch s152, "liquid soap" switch s153, "liquid detergent" switch s154 and "liquid neutral detergent" switch s155 all representative of detergent types and corresponding display sections d151 to d155 respectively. When desiring a washing manner according to a used detergent, the user selects one of the five types of detergents, depressing the corresponding switch. For example, when the user selects the "powdered synthetic detergent" and touches the switch s151, the terminal controller 9 obtains from the server 2 a screen 52 of "case where powdered synthetic detergent is used" as shown in FIG. 16, displaying the obtained screen on the touch panel 6.

Figure 17:
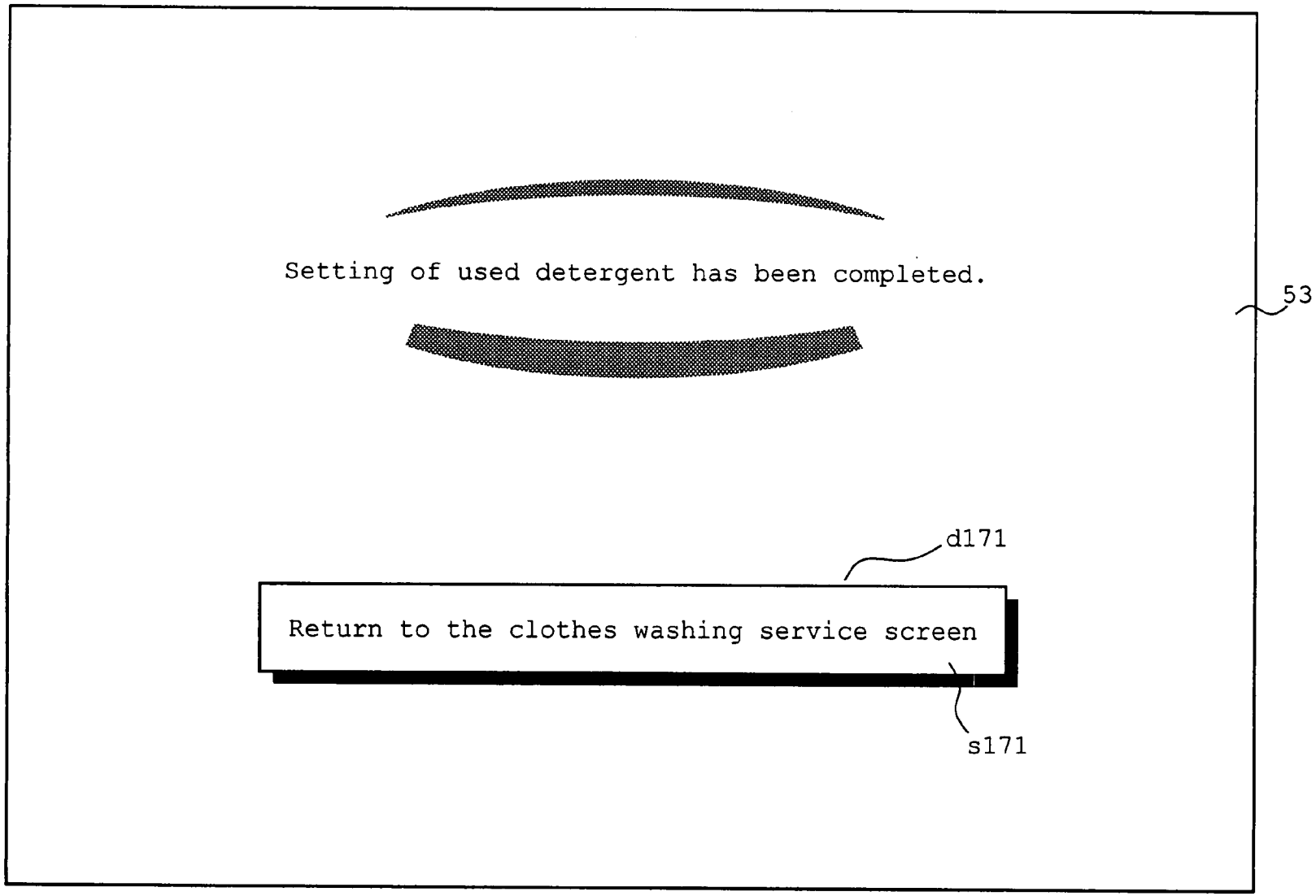
FIG. 17 shows a screen indicative of "setting of detergent used has been completed"

Guide information of "notices of use" is displayed on an upper part of the screen 51. A lower part of the screen 51 is provided with a switch s161 for setting control for operation with use of powdered synthetic detergent and a corresponding display section d161. The user selects the switch s161 when a powdered synthetic detergent is used. The terminal controller 9 then stores information that "use of powdered synthetic detergent" has been set as a constraint of "set of used detergent." At the same time, a screen 53 of "setting of used detergent has been completed" as shown in FIG. 17 is displayed, displaying that setting constraint of "setting of used detergent" has been completed. When the aforesaid "transmission" switch s93 is touched with the constraint of "set of used detergent" set, the terminal controller 9 transmits to the server 2 information that the constraint of "powdered synthetic detergent is used" (when constraints of aforesaid "atopy care" and "noise-reduced course" have been set, these pieces of information are included) has been set as the constraint of "set of used detergent" in addition to information about selected major and minor groups.

When retrieving from the data base an optimum operation control program corresponding to the received minor group of clothes, the server 2 retrieves and determines an optimum operation control program in consideration of the set constraint of "powdered synthetic detergent is used" (when constraints of "atopy care" and "noise-reduced course" have been set, these pieces of information are included), then transmitting it to the terminal controller 9.

Figure 19:
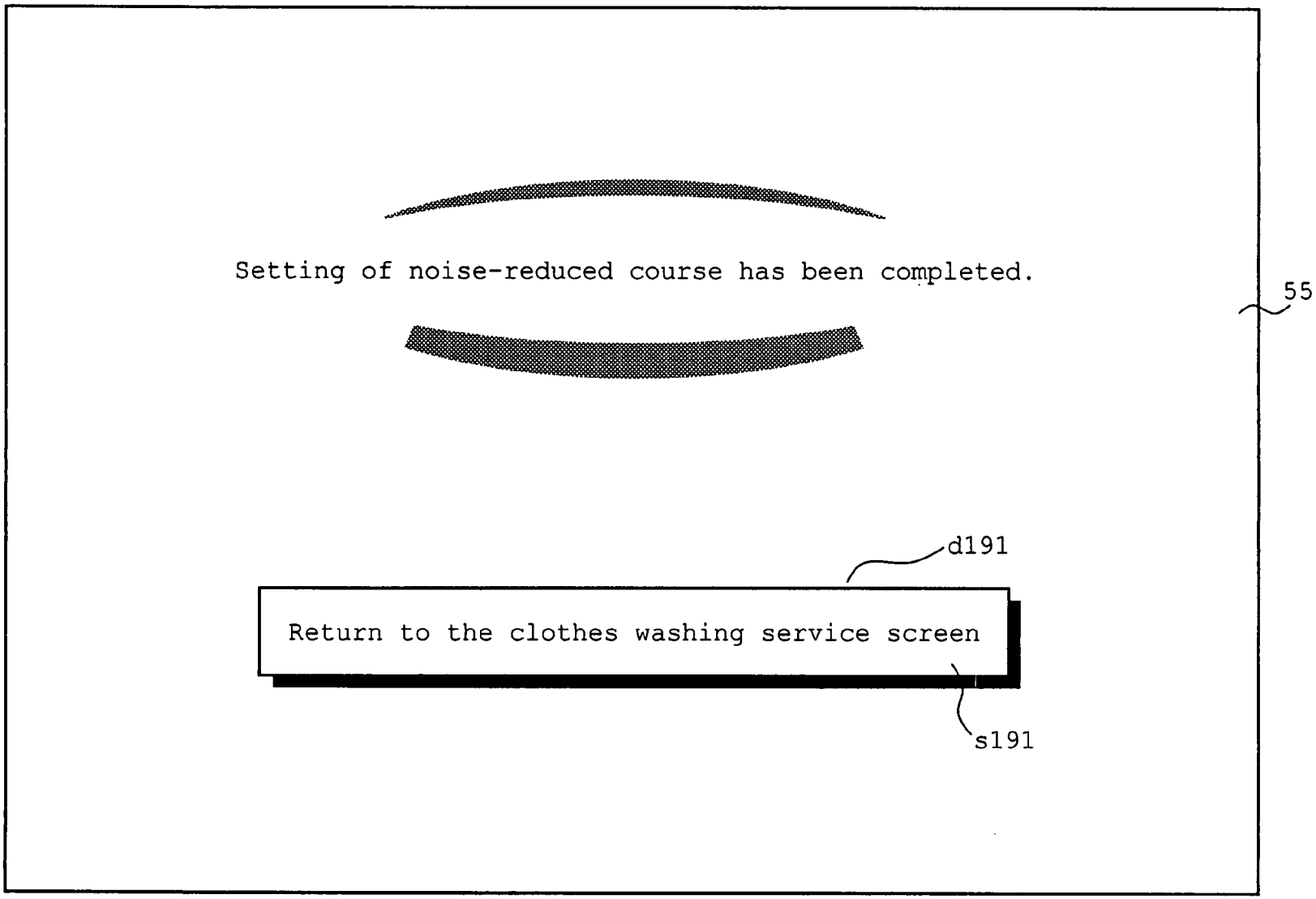
FIG. 19 shows a screen indicative of "noise-reduced course has been set"

Next, a case will be described where the menu of "a case where noise-reduced operation is desired" has been selected on the washing service screen 43 (menu screen of laundry system 1) as shown in FIG. 6. When the user touches the switch s64, the terminal controller 9 obtains the screen 54 of "a case where noise-reduced operation is desired" as shown in FIG. 18 from the server 2, displaying the obtained screen on the touch panel 6. Guide information of "clothes which can be set" relating to the setting of constraints of "noise-reduced course" is displayed on an upper part of the screen 54. A lower part of the screen 54 is provided with guide information of "notice." A central part of the screen 54 is provided with a "noise-reduced course" switch s181 for setting an operation for a noise-reduced course and a corresponding display section d181. The "noise-reduced course" denotes an operation of the laundry apparatus 4 with reduced noise. The switch s181 is selected when the user desires a noise-reduced operation. The terminal controller 9 then stores information that a constraint of "noise-reduced course" has been set. At the same time, a screen 55 of "setting of noise-reduced course has been completed" as shown in FIG. 19 is displayed, displaying that setting the constraint of "noise-reduced course" has been completed. When the aforesaid "transmission" switch S93 is touched with the constraint of "noise-reduced course" set, the terminal controller 9 transmits to the server 2 information that the constraint of "noise-reduced course" (when constraints of aforesaid "atopy care" and "set of used detergent" have been set, these pieces of information are included) has been set in addition to information about selected major and minor groups.

When retrieving from the data base an optimum operation control program corresponding to the received minor group clothes, the server 2 retrieves and determines an optimum operation control program in consideration of the set constraint of "noise-reduced course" (when constraints of "atopy care" and "set of used detergent" have been set, these pieces of information are included), then transmitting it to the terminal controller 9. When the option of "noise-reduced course" is set, an operation control program retrieved and determined usually contains reduced speed of drum motor 16*b* for rendering the washing time period longer than when the option of "noise-reduced course" is not set.

The following is the description of manipulation and operation for confirming a current operation of the laundry apparatus 4, altering the operation control program during execution thereof, and adding clothes. Each of these operations is initiated when a home appliance monitor switch s51 on the terminal menu screen 42 as shown in FIG. 5 is touched. Upon touch with the monitor switch s51, the laundry apparatus controller 17 is informed of the touch with the switch, then transmitting information about a current operating state of the laundry apparatus 4 to the terminal controller 9. The information includes progress in the washing and drying step, remaining time period to the completion of operation, set operation control program, etc.

Figure 20:
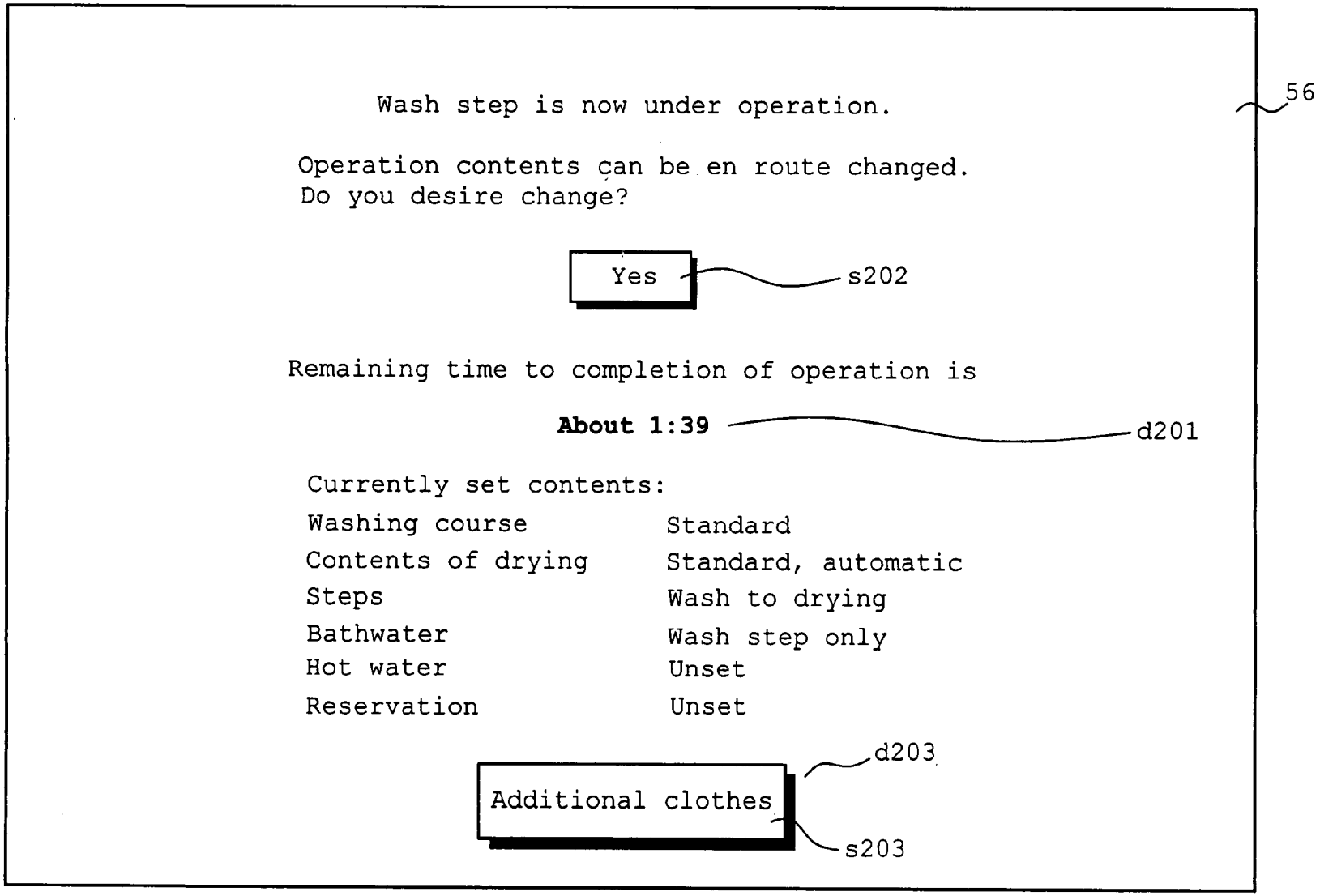
FIG. 20 shows a screen indicative of "operating state of laundry apparatus"
Figure 21:
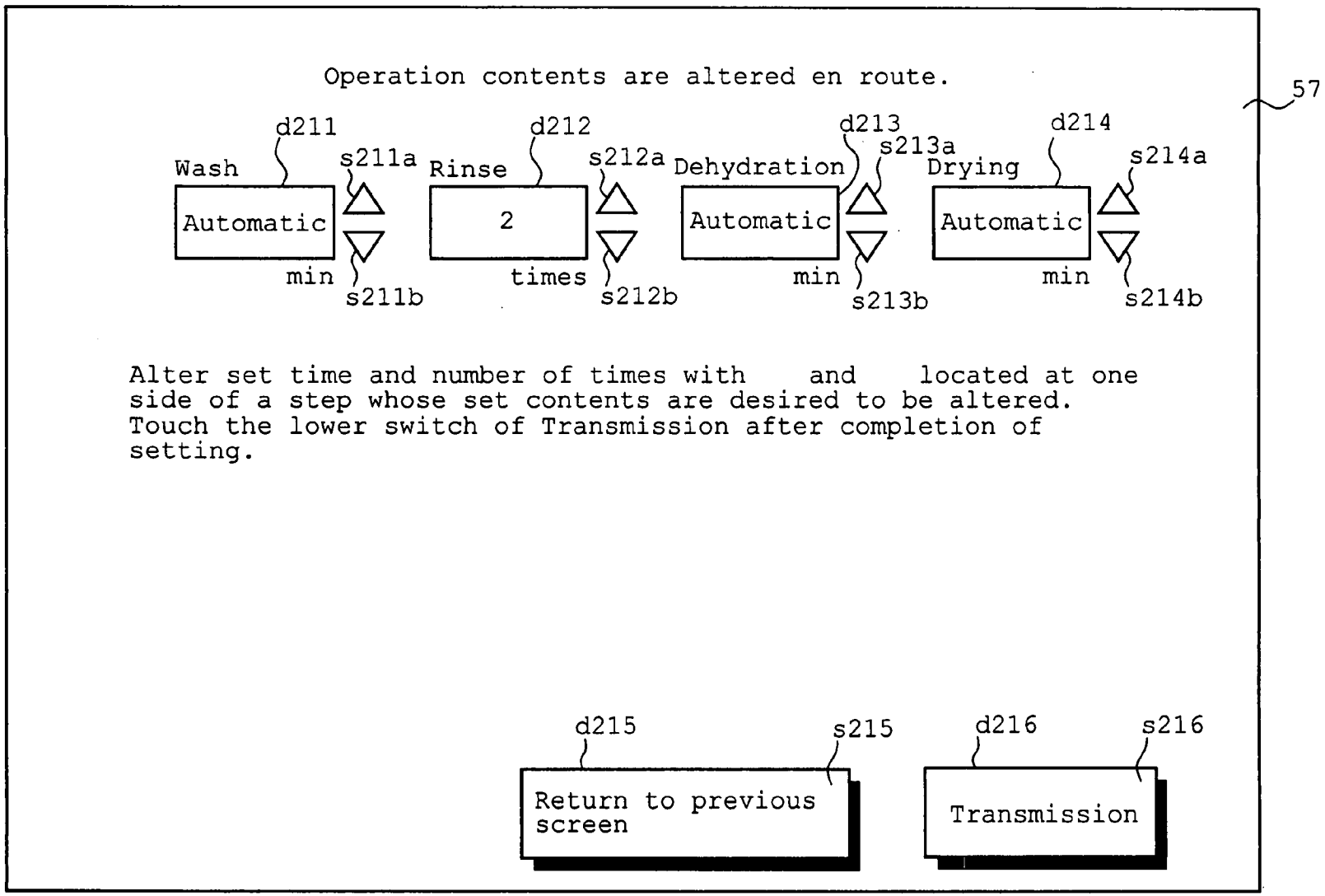
FIG. 21 shows a screen indicative of "en route alteration of operation contents"

Based on the received information, the terminal controller 9 displays an operating state of the laundry apparatus 4 on the touch panel 6. A screen to be displayed differs between a case where the laundry apparatus 4 is in operation and a case where the laundry apparatus 4 is on standby for a reserved operation. When the laundry apparatus 4 is in operation, an "operating state" screen 56 as shown in FIG. 20 is displayed. The screen 56 contains a step in execution, remaining time period, and operation control program, etc. The screen 56 includes an "operation content altering" switch s202. When the switch s202 is touched, the terminal controller 9 displays an "operation content altering" screen 57 as shown in FIG. 21. An upper part of the screen 56 includes a "wash" display section d211, "rinse" display section d212, "dehydration" display section d213, and "drying" display section d214. Each display section displays the content of the current operation control program which is set in the laundry apparatus 4. Of these display sections d211 to d214, those displaying "automatic" refer to items which cannot be altered en route during operation. Switches s211*a* to s214*a* for increasing the displayed set values are provided to the right of the display sections respectively. Switches s211*b* to s214*b* for decreasing the displayed set values are also provided to the right of the display sections respectively. When desiring an alteration, the user operates these switches so that the set values are changed and then a lower "transmission" switch s216 is touched. As a result, data of a changed set value is transmitted from the laundry apparatus controller 17 of the laundry apparatus 4, whereby the operation control program is altered. Information about the foregoing changeable and unchangeable items is contained in the operation control program the terminal controller 9 receives from the server 2.

Figure 22:
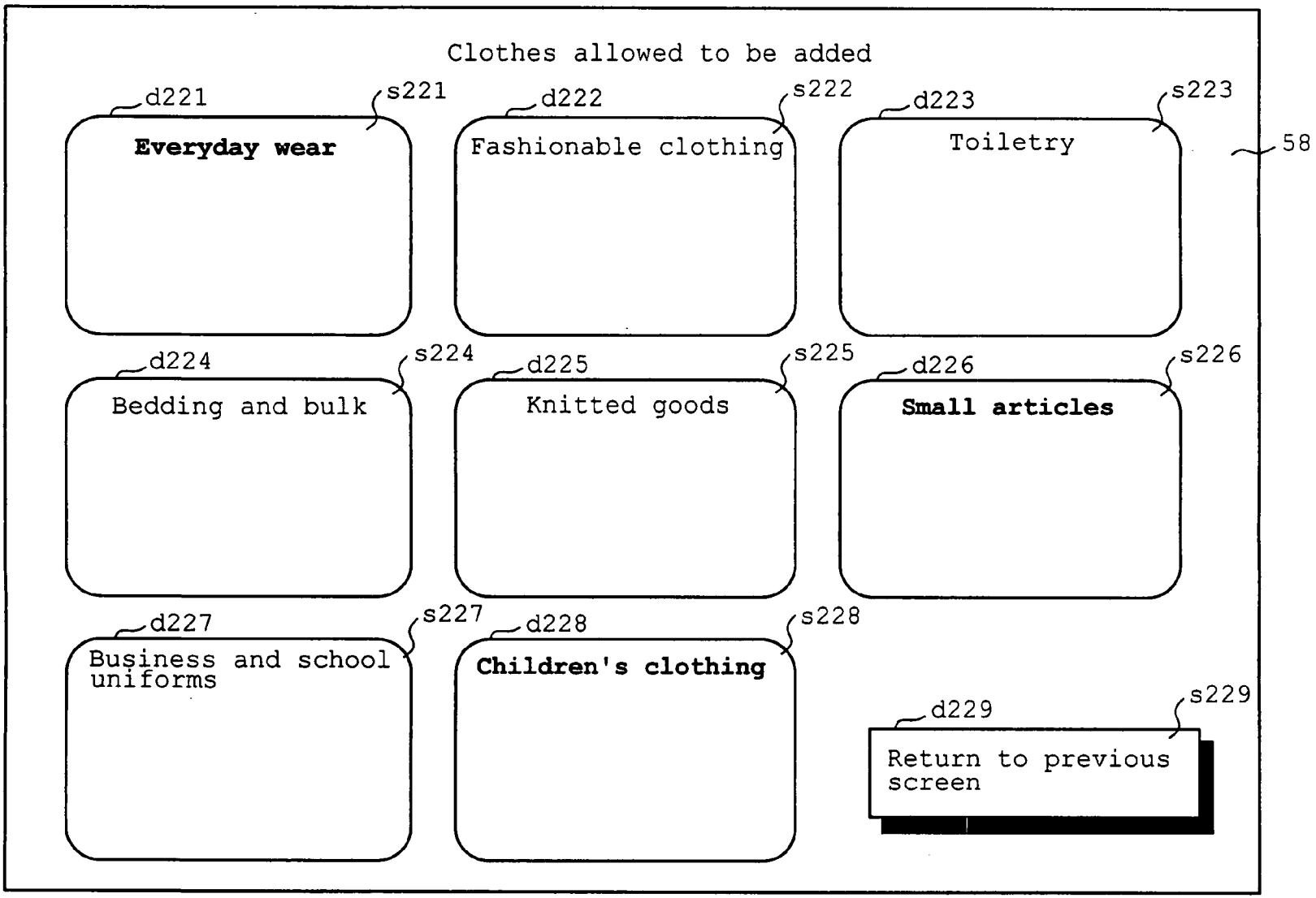
FIG. 22 shows a screen indicative of "clothes allowed to be added"

A case will then be described where the user has touched an "additional clothes" switch s203 provided in the lower part of a "laundry apparatus operating state" screen 56. In this case, the terminal controller 9 displays an "additional clothes" screen 58 as shown in FIG. 22. Since the information on the screen 58 is also stored on the data base of the server 2, the terminal controller 9 transmits to the server 2 information about the major and minor group clothes under washing, receiving and displaying a reply. The "additional clothes" screen 58 includes display sections d221 to d228 displaying additional clothes of the major group. The screen 58 has substantially the same arrangement as the aforesaid clothes of the major group screen 44 (FIG. 7). The display sections include those having bold names, that is, "everyday clothes" d221, "small articles" d226 and "children's clothing" d228. These display sections d221, d226 and d228 indicate major groups of additional clothes in this case. The other major groups whose names are shown void indicate those which are unsuitable for additional clothes. Regarding information of the additional clothes of the major group, too, the terminal controller 9 transmits information of clothes (major and minor groups) under processing to the server 2, receiving and displaying a reply.

Figure 23:
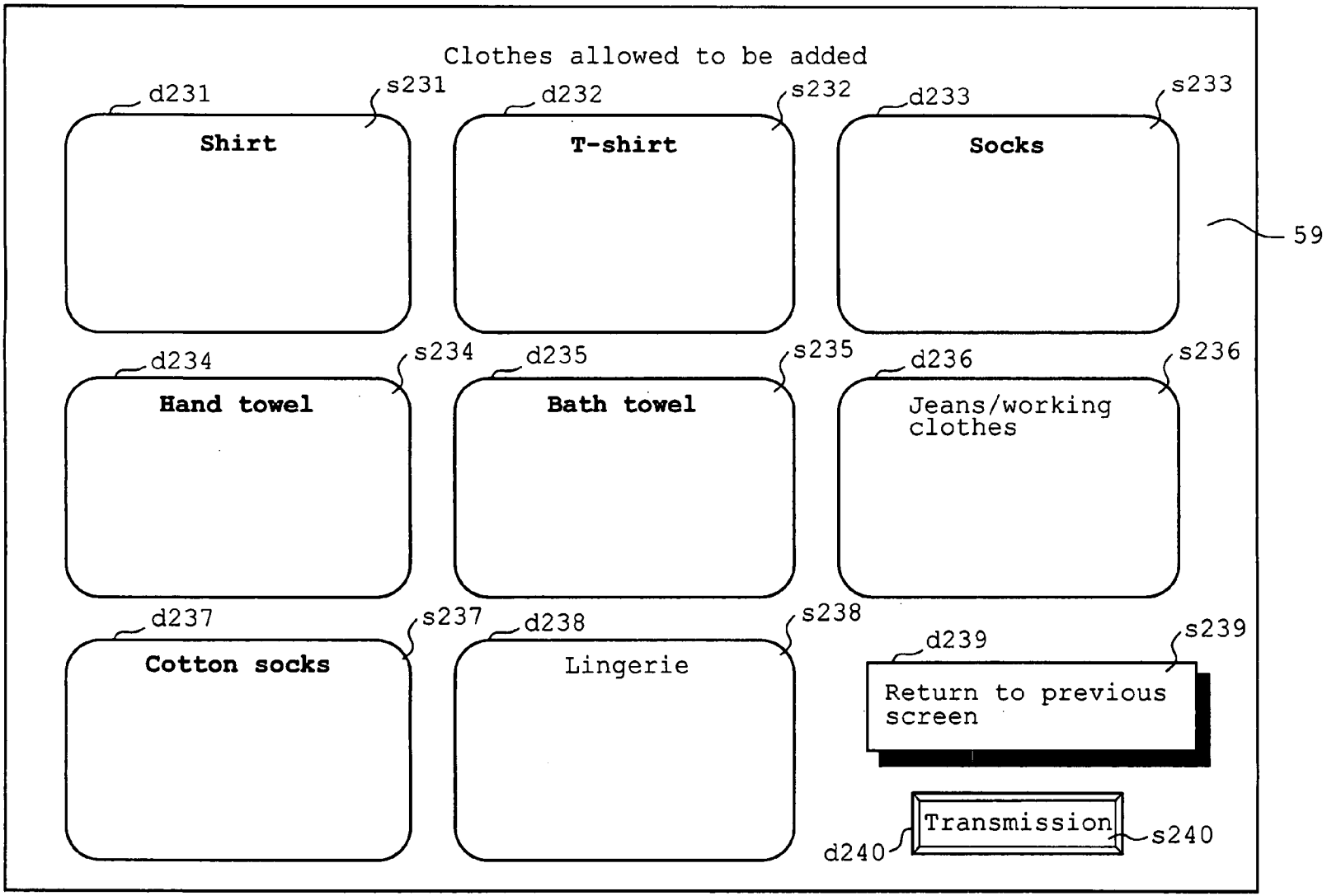
FIG. 23 shows a screen indicative of "everyday clothes allowed to be added"

When desiring addition of clothes, the user selects and depresses a major group of clothes to be added from the switches s221 to s228. Assume now that the user has touched the "everyday clothes" switch s221. The terminal controller 9 then displays a screen 59 of "additional everyday clothes" as shown in FIG. 23. The screen 59 includes display sections d231 to d238 displaying minor classification clothes corresponding to the major group of "everyday clothes." The display sections d231 to d238 include those having bold names, that is, "shirt" d231, "T-shirt" S232, "socks" s233, "handtowel" s234, "bathtowel" s235 and "cotton socks" s237. The other display sections of minor groups having void names indicate those which are unsuitable for additional clothes. Regarding information of the major groups of additional clothes, too, the terminal controller 9 transmits information of clothes (major and minor groups) under processing to the server 2, receiving and displaying a reply.

The user touches and selects one or more minor group switches of the clothes which are desired to be added. The user then touches a "transmission" switch s239 located in a lower part of the screen 59. The terminal controller 9 transmits to the server 2 information of major and minor groups of clothes which are desired to be added, information of currently selected major and minor groups of clothes and information of previously set constraints. The server 2 retrieves and composes a new operation control program on the data base in view of the afore-mentioned pieces of information, then replying to the terminal controller 9. The terminal controller 9 transmits the received new operation control program to the laundry apparatus 4. The laundry apparatus 4 is interrupted and substitutes the received new operation control program for the previous one, thereafter restarting the operation.

Figure 24:
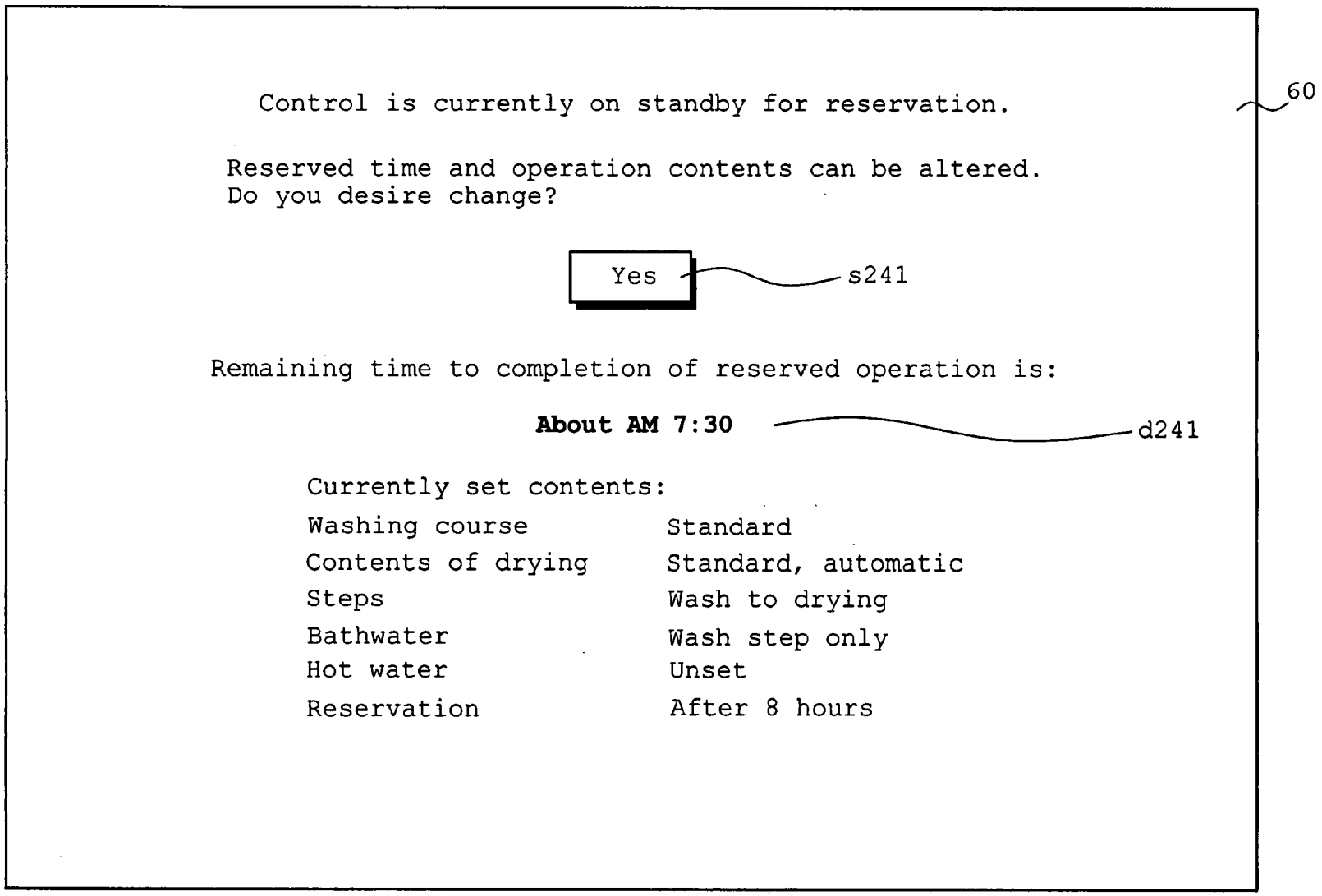
FIG. 24 shows a screen indicative of "standby state of laundry apparatus"

A "laundry apparatus standby state" screen 60 as shown in FIG. 24 is displayed when the laundry apparatus 4 is on standby upon touch with the home appliance monitor switch s51. In a case where a desired finish time has been set by the "reserved course" switch s92 on the screen as shown in FIG. 9, the laundry apparatus 4 is on standby when a start time is not reached by reverse calculation using the desired finish time. On the screen 60, an indication of "reserved operation finish time" d241 is displayed instead of an indication of "time left until operation finish" d201 displayed on the afore-mentioned "laundry apparatus operating state" screen 56 (FIG. 20). The "reserved operation finish time" refers to the above-described desired finish time.

Figure 25:
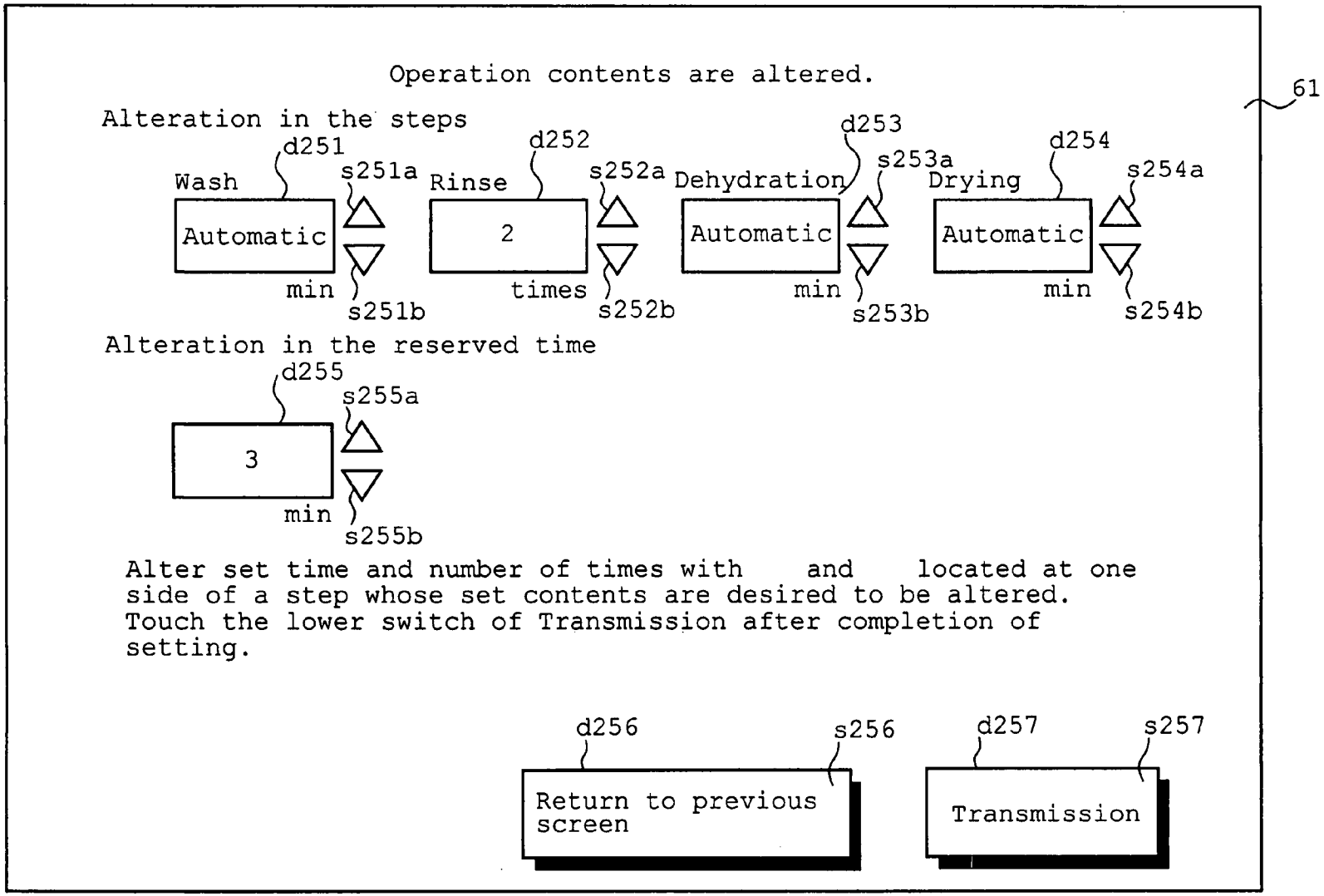
FIG. 25 shows a screen indicative of "alteration of operational contents"

The screen 60 is provided with a "reserved time/operational content altering" switch s241. When the switch s241 is touched, the terminal controller 9 displays an "operational content altering" screen 61 as shown in FIG. 25. The screen 61 is similar to the aforesaid "operation content altering" screen 57 (FIG. 21). The screen 60 includes upper four display sections d251 to d254 indicating items of "wash," "rinse," "dehydration" and "drying" and corresponding switches s251*a* to s254*a* and s251*b* to s252*b* respectively. The display sections and switches have substantially the same functions as those of the screen 57.

Figure 26:
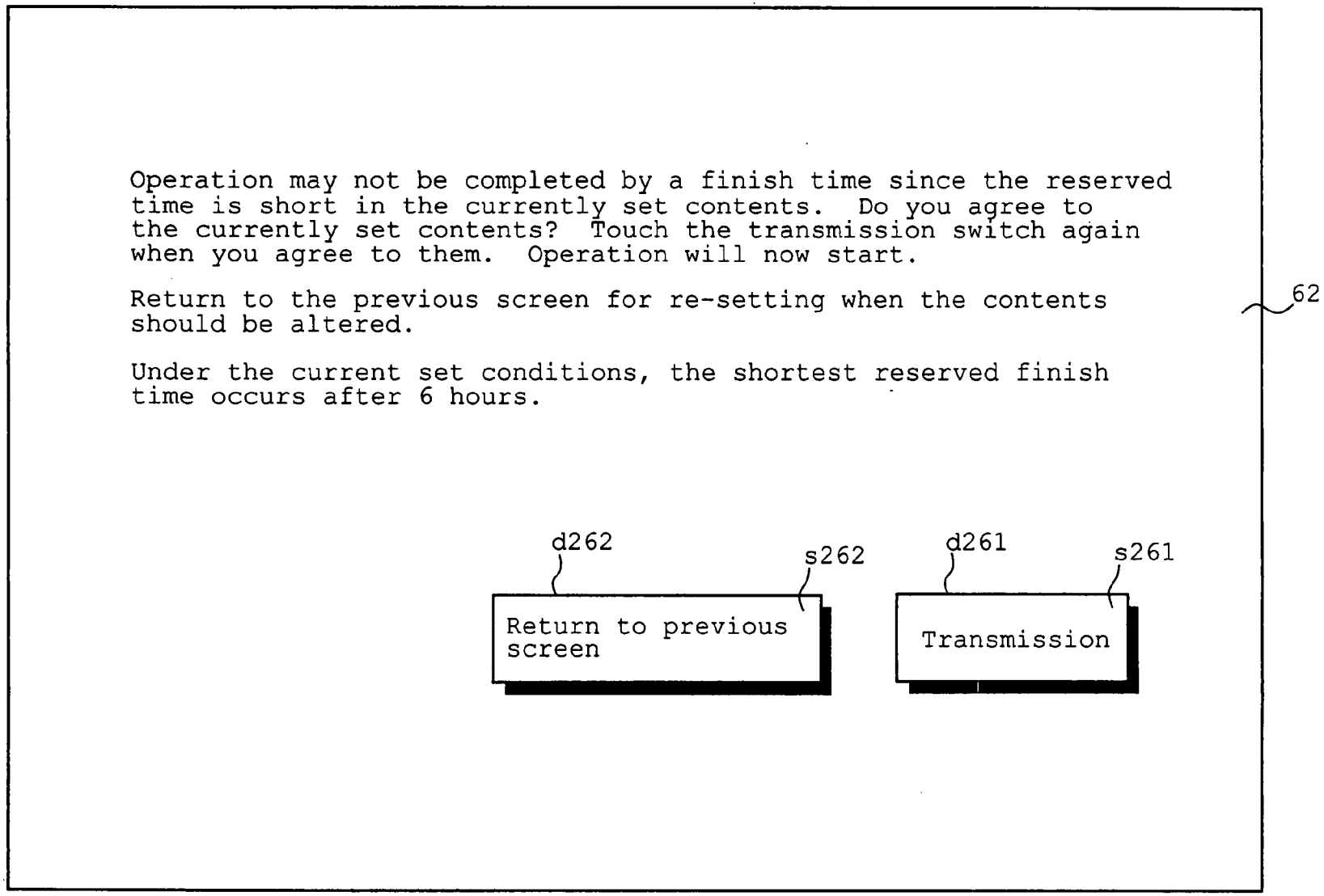
FIG. 26 shows a screen indicative of "confirmation of desired time"

The centrally located "alteration in the reserved time" display section d255 of the screen 60 displays a set desired finish time. When the user desires an alteration, a time increment switch s255*a* or a time decrement switch s255*b* is operated so that the time is changed to a new one. The lower "transmission" switch 257 is then touched. The terminal controller 9 obtains a start time by reverse calculation on the basis of the changed desired time and then checks if the current time has not passed the start time. When the current time has passed the start time, a "desired time confirmation" screen 62 as shown in FIG. 26 is displayed. When the desired start time has been reached, the terminal controller 9 informs that the operation of the laundry apparatus 4 will be started at once. The user touches the "transmission" switch s261 when the operation may be started at once. When the operation should not be started at once, the user touches a "return" switch s262, returning to the previous screen 61 to try the setting again. On the other hand, the terminal controller 9 transmits data of the changed desired finish time to the laundry apparatus controller 17 when the current time has not passed the start time or when the "transmission" switch s261 on the screen 62 has been touched. As a result, the desired finish time the data of which is stored by the laundry apparatus 4 is changed. The laundry apparatus controller 17 starts the operation of the laundry apparatus 4 at once when the current time has passed an operation start time obtained by reverse calculation on the basis of the changed desired finish time.

A case will then be described where the operation control program has been altered at the laundry apparatus 4 side. When the laundry apparatus 4 is in operation according to the operation control program transmitted thereto from the terminal controller 9, an "internet course" display section 40 on the operation panel 14 of the laundry apparatus 4 as shown in FIG. 4 is lit. When the user uses any one of the switches 19 to 27 of the operation panel 14 to alter the operation control program in the above-mentioned state, data indicating that the operation control program has been altered and data of changed contents are transmitted to the terminal controller 9. The terminal controller 9 then displays a "caution" screen 63 as shown in FIG. 27. The "caution" screen 63 displays that the operation control program has been altered and the changed contents. Data of the changed contents of the operation control program is also transmitted to the server 2 at the same time. The server 2 compares the changed contents with the previous operation control program, thereby informing the user of caution when the caution is considered to arouse user's attention. The terminal controller 9 displays the contents of caution on a lower part of the "caution" screen 63, thereby arousing user's attention.

Laundry is carried out by the laundry system 1 in the above-described manipulation and operation. Consequently, the user can get an optimum effect according to the clothes with simplified manipulation without relying upon experience and intuition.

The present invention should not be limited by the foregoing embodiment and may be modified without departing from the scope thereof. For example, the server 2 may be informed of the type name and type number of the laundry apparatus 4 when the terminal controller 9 transmits major and minor groups of clothes to be washed and dried etc. to the server 2 and receives a reply of the operation control program. The server 2 may then retrieve and determine an optimum operation control program in view of the type name and type number. Consequently, a more effect may be achieved from laundry.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A laundry system comprising a terminal device and a laundry apparatus, the terminal device including:

a display panel;

an input panel;

a first short-range communication device;

a long-range communication device; and a terminal device controller transmitting information about clothes as laundry and information about a laundry constraint both set on the input panel, to a server connected to a long-range communication network for providing laundry control information, using the long-range communication device, thereby obtaining an operation control program for the laundry apparatus on the basis of the two pieces of information, the terminal device controller transmitting the obtained operation control program via the first short-range communication device to the laundry apparatus, the terminal device controller receiving via the first short-range communication device information about an operating state of the laundry apparatus, displaying the information on the display panel; and the laundry apparatus including:

an operation panel;

a laundry unit;

a second short-range communication device; and a laundry apparatus controller receiving the operation control program via the second short-range communication device from the terminal device to control the laundry unit so that laundry is washed and/or dried, the laundry apparatus controller transmitting to the terminal device the information about the operating state of the laundry apparatus via the second short-range communication device, wherein the terminal device controller obtains from the server a plurality of major groups of clothes to be laundered to display the obtained major groups on the display panel, the terminal device controller obtaining from the server a plurality of minor groups of clothes belonging to a selected one of the major groups, displaying the obtained minor groups on the display panel, the terminal device controller obtains from the server a piece of guide information about laundry of clothes belonging to a selected one of the minor groups to display the obtained information on the display panel, and when two or more minor groups obtained from the server are designated as laundry, the terminal device controller obtains from the server an operation control program for the laundry apparatus in consideration of the two or more selected minor groups thereby to transfer the obtained operation control program to the laundry apparatus.

2. A laundry system comprising a terminal device and a laundry apparatus, the terminal device including:

a display panel;

an input panel;

a first short-range communication device;

a long-range communication device; and a terminal device controller transmitting information about clothes as laundry and information about a laundry constraint both set on the input panel, to a server connected to a long-range communication network for providing laundry control information, using the long-range communication device, thereby obtaining an operation control program for the laundry apparatus on the basis of the two pieces of information, the terminal device controller transmitting the obtained operation control program via the first short-range communication device to the laundry apparatus, the terminal device controller receiving via the first short-range communication device information about an operating state of the laundry apparatus, displaying the information on the display panel; and the laundry apparatus including:

an operation panel;

a laundry unit;

a second short-range communication device; and a laundry apparatus controller receiving the operation control program via the second short-range communication device from the terminal device to control the laundry unit so that laundry is washed and/or dried, the laundry apparatus controller transmitting to the terminal device the information about the operating state of the laundry apparatus via the second short-range communication device, wherein when an "atopy care" course has been selected as the laundry constraint, the terminal device controller obtains from the server the operation control program taking the selected laundry constraint into account, transferring the obtained operation control program to the laundry apparatus.

3. A laundry system comprising a terminal device and a laundry apparatus, the terminal device including:

a display panel;

an input panel;

a first short-range communication device;

a long-range communication device; and a terminal device controller transmitting information about clothes as laundry and information about a laundry constraint both set on the input panel, to a server connected to a long-range communication network for providing laundry control information, using the long-range communication device, thereby obtaining an operation control program for the laundry apparatus on the basis of the two pieces of information, the terminal device controller transmitting the obtained operation control program via the first short-range communication device to the laundry apparatus, the terminal device controller receiving via the first short-range communication device information about an operating state of the laundry apparatus, displaying the information on the display panel; and the laundry apparatus including:

an operation panel;

a laundry unit;

a second short-range communication device; and a laundry apparatus controller receiving the operation control program via the second short-range communication device from the terminal device to control the laundry unit so that laundry is washed and/or dried, the laundry apparatus controller transmitting to the terminal device the information about the operating state of the laundry apparatus via the second short-range communication device, wherein when the operation panel of the laundry apparatus has been operated so that contents of the operation control program have been changed, the laundry apparatus controller transfers the changed contents of the operation control program to the terminal controller and displays the changed contents of the operation control program on the display panel.

* * * * *